US010151187B1

(12) United States Patent
Wright et al.

(10) Patent No.: US 10,151,187 B1
(45) Date of Patent: Dec. 11, 2018

(54) HYDROCARBON RESOURCE RECOVERY SYSTEM WITH TRANSVERSE SOLVENT INJECTORS AND RELATED METHODS

(71) Applicant: EAGLE TECHNOLOGY, LLC, Melbourne, FL (US)

(72) Inventors: Brian N. Wright, Indialantic, FL (US); Warren MacPhail, Calgary (CA); Alan Watt, Cochrane (CA)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 15/893,941

(22) Filed: Feb. 12, 2018

(51) Int. Cl.

| | |
|---|---|
| ***E21B 43/24*** | (2006.01) |
| ***E21B 36/04*** | (2006.01) |
| ***H01Q 9/22*** | (2006.01) |
| ***H01Q 1/04*** | (2006.01) |

(52) U.S. Cl.
CPC ..... *E21B 43/2408* (2013.01); *E21B 36/04* (2013.01); *E21B 43/2401* (2013.01); *H01Q 1/04* (2013.01); *H01Q 9/22* (2013.01)

(58) Field of Classification Search
None
See application file for complete search history.

(56) References Cited

U.S. PATENT DOCUMENTS

| | | | |
|---|---|---|---|
| 4,625,806 | A | 12/1986 | Silcox |
| 4,646,828 | A | 3/1987 | Schwab, Jr. et al. |
| 4,662,437 | A | 5/1987 | Renfro |
| 5,211,242 | A | 5/1993 | Coleman et al. |
| 5,329,998 | A | 7/1994 | King et al. |
| 5,390,742 | A | 2/1995 | Dines et al. |
| 5,586,213 | A | 12/1996 | Bridges et al. |
| 5,621,845 | A | 4/1997 | Bridges et al. |
| 6,041,860 | A | 3/2000 | Nazzal et al. |
| 6,216,804 | B1 | 4/2001 | Aumann et al. |
| 6,497,281 | B2 | 12/2002 | Vann |
| 6,772,840 | B2 | 8/2004 | Headworth |
| 6,868,906 | B1 | 3/2005 | Vail, III et al. |
| 6,968,902 | B2 | 11/2005 | Fenton et al. |
| 7,325,606 | B1 | 2/2008 | Vail, III et al. |
| 7,441,597 | B2 | 10/2008 | Kasevich |
| 7,540,324 | B2 | 6/2009 | de Rouffignac et al. |
| 7,562,708 | B2 | 7/2009 | Cogliandro et al. |
| 7,669,657 | B2 | 3/2010 | Symington et al. |
| 7,891,421 | B2 | 2/2011 | Kasevich |
| 8,616,273 | B2 | 12/2013 | Trautman et al. |
| 9,109,415 | B2 | 8/2015 | Coles |

(Continued)

*Primary Examiner* — Anuradha Ahuja
(74) *Attorney, Agent, or Firm* — Allen, Dyer, Doppelt + Gilchrist, P.A.

(57) ABSTRACT

A hydrocarbon resource recovery system may include an RF source, and an RF antenna assembly coupled to the RF source and extending laterally within a wellbore in a subterranean formation for hydrocarbon resource recovery. The RF antenna assembly may include first and second tubular conductors, and a dielectric isolator coupled between the first and second tubular conductors to define a dipole antenna. The hydrocarbon resource recovery system may include solvent injectors within respective laterally extending wellbores extending transverse and above the RF antenna assembly and configured to selectively inject solvent into the subterranean formation adjacent the RF antenna assembly.

22 Claims, 44 Drawing Sheets

(56) References Cited

U.S. PATENT DOCUMENTS

| | | | |
|---|---|---|---|
| 9,181,790 | B2 | 11/2015 | Mace et al. |
| 9,297,232 | B2 | 3/2016 | Scott et al. |
| 9,376,897 | B2 | 6/2016 | Ayers et al. |
| 9,598,945 | B2 | 3/2017 | Okoniewski et al. |
| 9,752,406 | B2 | 9/2017 | Hardesty et al. |
| 2003/0034177 | A1 | 2/2003 | Chitwood et al. |
| 2004/0040707 | A1 | 3/2004 | Dusterhoft et al. |
| 2004/0060735 | A1 | 4/2004 | Beckman |
| 2004/0244990 | A1 | 12/2004 | Herr |
| 2006/0124360 | A1 | 6/2006 | Lee et al. |
| 2006/0243450 | A1 | 11/2006 | Head |
| 2007/0051510 | A1 | 3/2007 | Veneruso et al. |
| 2007/0144741 | A1 | 6/2007 | Cho et al. |
| 2008/0128128 | A1 | 6/2008 | Vail et al. |
| 2009/0236144 | A1 | 9/2009 | Todd et al. |
| 2010/0078163 | A1 | 4/2010 | Banerjee et al. |
| 2010/0294488 | A1 | 11/2010 | Wheeler et al. |
| 2010/0294489 | A1 | 11/2010 | Dreher, Jr. et al. |
| 2011/0011646 | A1 | 1/2011 | Giroux et al. |
| 2011/0114387 | A1 | 5/2011 | Belcher et al. |
| 2011/0132600 | A1 | 6/2011 | Kaminsky et al. |
| 2011/0146982 | A1 | 6/2011 | Kaminsky et al. |
| 2011/0214920 | A1 | 9/2011 | Vail et al. |
| 2011/0290561 | A1 | 12/2011 | Randall et al. |
| 2012/0037360 | A1 | 2/2012 | Arizmendi, Jr. et al. |
| 2012/0292051 | A1 | 11/2012 | Wetzel et al. |
| 2012/0325458 | A1 | 12/2012 | El-Rabaa et al. |
| 2013/0043034 | A1 | 2/2013 | Drablier et al. |
| 2013/0098632 | A1 | 4/2013 | Wetzel et al. |
| 2013/0112403 | A1 | 5/2013 | Meurer et al. |
| 2013/0138254 | A1 | 5/2013 | Seals et al. |
| 2013/0180708 | A1 | 7/2013 | Ware et al. |
| 2013/0248179 | A1 | 9/2013 | Yeh et al. |
| 2013/0269945 | A1 | 10/2013 | Hoffman et al. |
| 2013/0334205 | A1* | 12/2013 | Wright ..... E21B 43/2406 219/541 |
| 2014/0083712 | A1 | 3/2014 | Vick et al. |
| 2014/0102721 | A1 | 4/2014 | Bespalov et al. |
| 2014/0131035 | A1 | 5/2014 | Entchev et al. |
| 2014/0224472 | A1* | 8/2014 | Parsche ..... H01Q 9/16 166/60 |
| 2014/0262220 | A1 | 9/2014 | Guerrero et al. |
| 2014/0262224 | A1* | 9/2014 | Ayers ..... E21B 43/2401 166/248 |
| 2014/0299330 | A1 | 10/2014 | Fripp et al. |
| 2014/0332218 | A1 | 11/2014 | Castrogiovanni et al. |
| 2014/0374090 | A1 | 12/2014 | Gonzalez Davila |
| 2015/0060052 | A1 | 3/2015 | Caryotakis |
| 2015/0068706 | A1* | 3/2015 | Hann ..... H05B 6/00 165/45 |
| 2016/0047194 | A1 | 2/2016 | Snider et al. |
| 2016/0047195 | A1 | 2/2016 | Snider et al. |
| 2016/0047198 | A1 | 2/2016 | Hardesty et al. |
| 2016/0047199 | A1 | 2/2016 | Hardesty et al. |
| 2016/0251940 | A1 | 9/2016 | De Witt et al. |
| 2016/0312589 | A1 | 10/2016 | Decarlo |
| 2017/0044865 | A1 | 2/2017 | Sabins et al. |
| 2017/0044875 | A1 | 2/2017 | Hebebrand et al. |
| 2017/0175505 | A1 | 6/2017 | Curlett |

* cited by examiner

HYDROCARBON RESOURCE RECOVERY SYSTEM WITH TRANSVERSE SOLVENT INJECTORS AND RELATED METHODS

TECHNICAL FIELD

The present invention relates to the field of hydrocarbon resource processing, and, more particularly, to a hydrocarbon resource recovery system with solvent injection and related methods.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is typically used to inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGO process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable. For example, it may be relatively difficult to install or integrate RF heating equipment into existing wells.

SUMMARY

Generally speaking, a hydrocarbon resource recovery system may include an RF source, and at least one RF antenna assembly coupled to the RF source and extending laterally within a wellbore in a subterranean formation for hydrocarbon resource recovery. The at least one RF antenna assembly may include first and second tubular conductors, and a dielectric isolator coupled between the first and second tubular conductors to define a dipole antenna. The hydrocarbon resource recovery system may include a plurality of solvent injectors within respective laterally extending wellbores extending transverse and above the at least one RF antenna assembly and configured to selectively inject solvent into the subterranean formation adjacent the at least one RF antenna assembly.

In some embodiments, the at least one RF antenna assembly may comprise a plurality thereof, and each solvent injector may comprise a plurality of flow regulators respectively aligned with respective ones of the plurality of RF antenna assemblies. The plurality of flow regulators may each have a selective flow rate. Each solvent injector may comprise a plurality of isolation packers with a respective flow regulator therebetween.

Moreover, the plurality of solvent injectors may include a first solvent injector aligned with a proximal end of the at least one RF antenna assembly, a second solvent injector aligned with a medial portion of the at least one RF antenna assembly, and a third solvent injector aligned with a distal end of the at least one RF antenna assembly. The at least one RF antenna assembly may comprise a dielectric choke coupled to the first tubular conductor. The at least one RF antenna assembly may comprise an RF transmission line coupled between the RF source and the first and second tubular conductors.

Additionally, the at least one RF antenna assembly may define first and second fluid passageways configured to circulate a dielectric fluid from a surface of the subterranean formation. The wellbore may comprise a cased wellbore defining a fluid passageway between the at least one RF antenna assembly and the cased wellbore. The hydrocarbon resource recovery system may include at least one producer well within the subterranean formation below the at least one RF antenna assembly.

Another aspect is directed to a method of hydrocarbon resource recovery with a hydrocarbon resource recovery system. The hydrocarbon resource recovery system may include an RF source, and at least one RF antenna assembly coupled to the RF source and extending laterally within a wellbore in a subterranean formation for hydrocarbon resource recovery. The at least one RF antenna assembly may include first and second tubular conductors, and a dielectric isolator coupled between the first and second tubular conductors to define a dipole antenna. The method may comprise operating a plurality of solvent injectors within respective laterally extending wellbores extending transverse and above the at least one RF antenna assembly, the plurality of solvent injectors selectively injecting solvent into the subterranean formation adjacent the at least one RF antenna assembly.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and prime notation is used to indicate similar elements in alternative embodiments.

Figure 1:
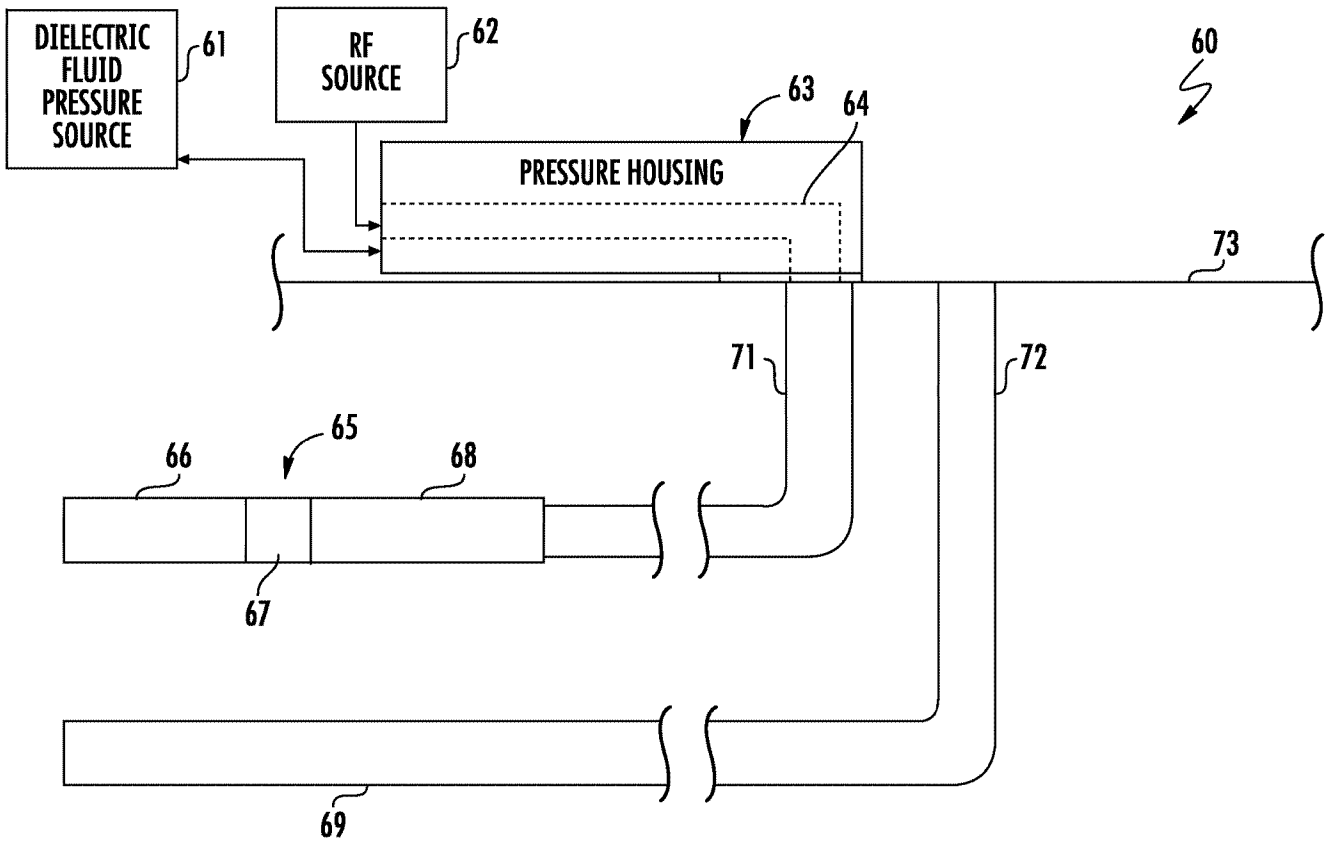
FIG. 1 is a schematic diagram of a hydrocarbon resource recovery system, according to the present disclosure.
Figure 2:
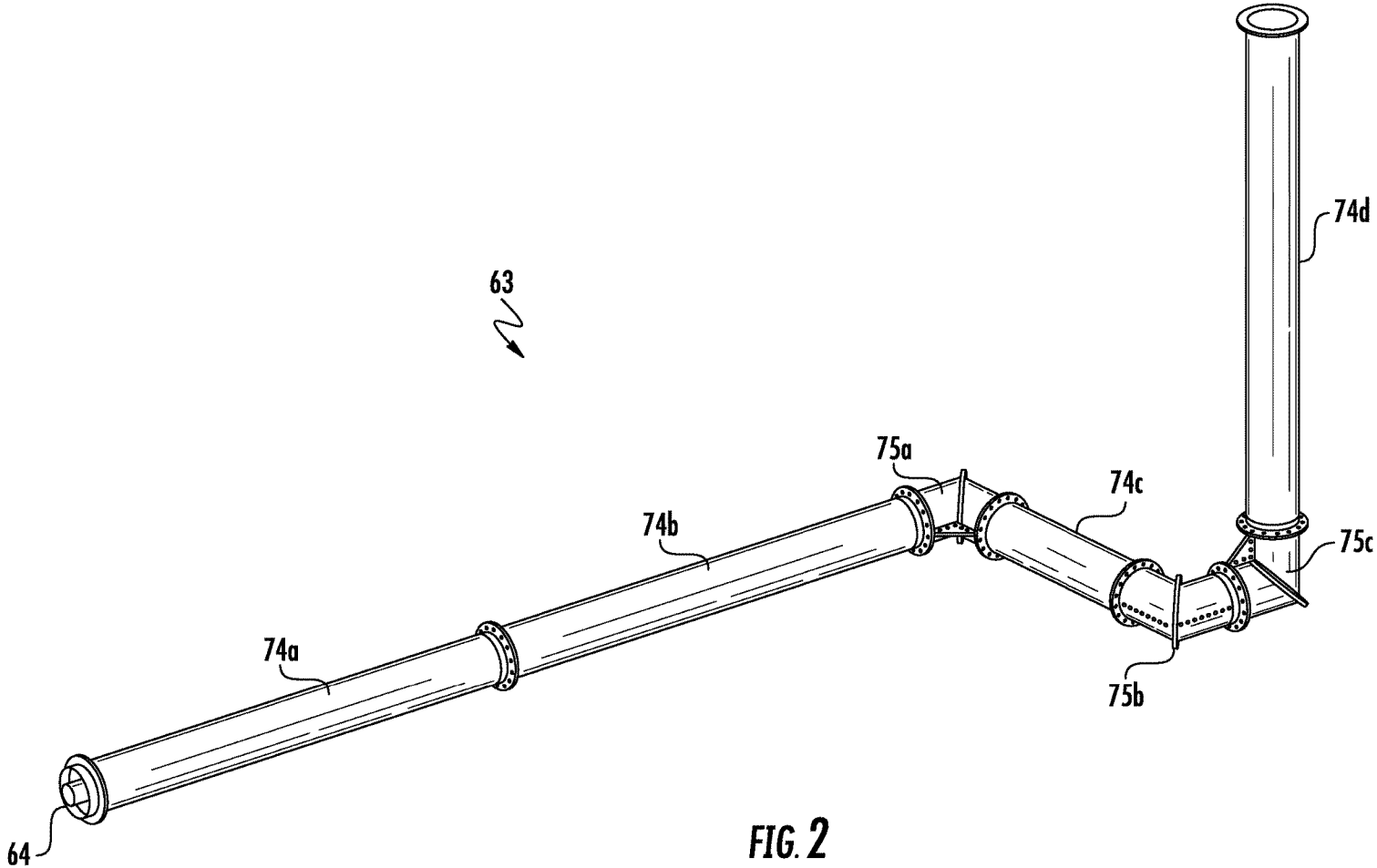
FIG. 2 is a perspective view of a plurality of pressure members from the hydrocarbon resource recovery system of FIG. 1.
Figure 3:
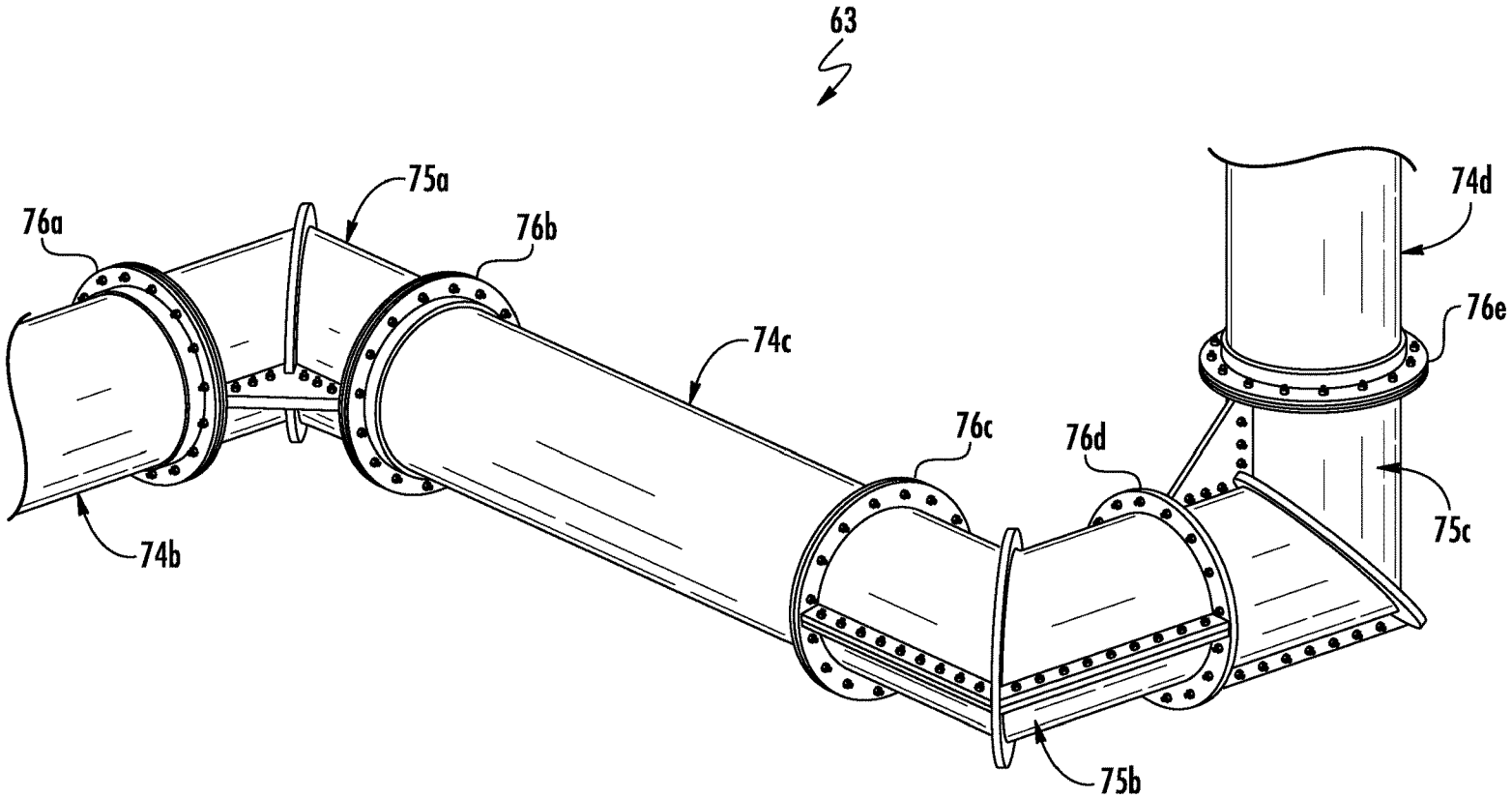
FIG. 3 is an enlarged perspective view of the plurality of pressure members from the hydrocarbon resource recovery system of FIG. 1.
Figure 4:
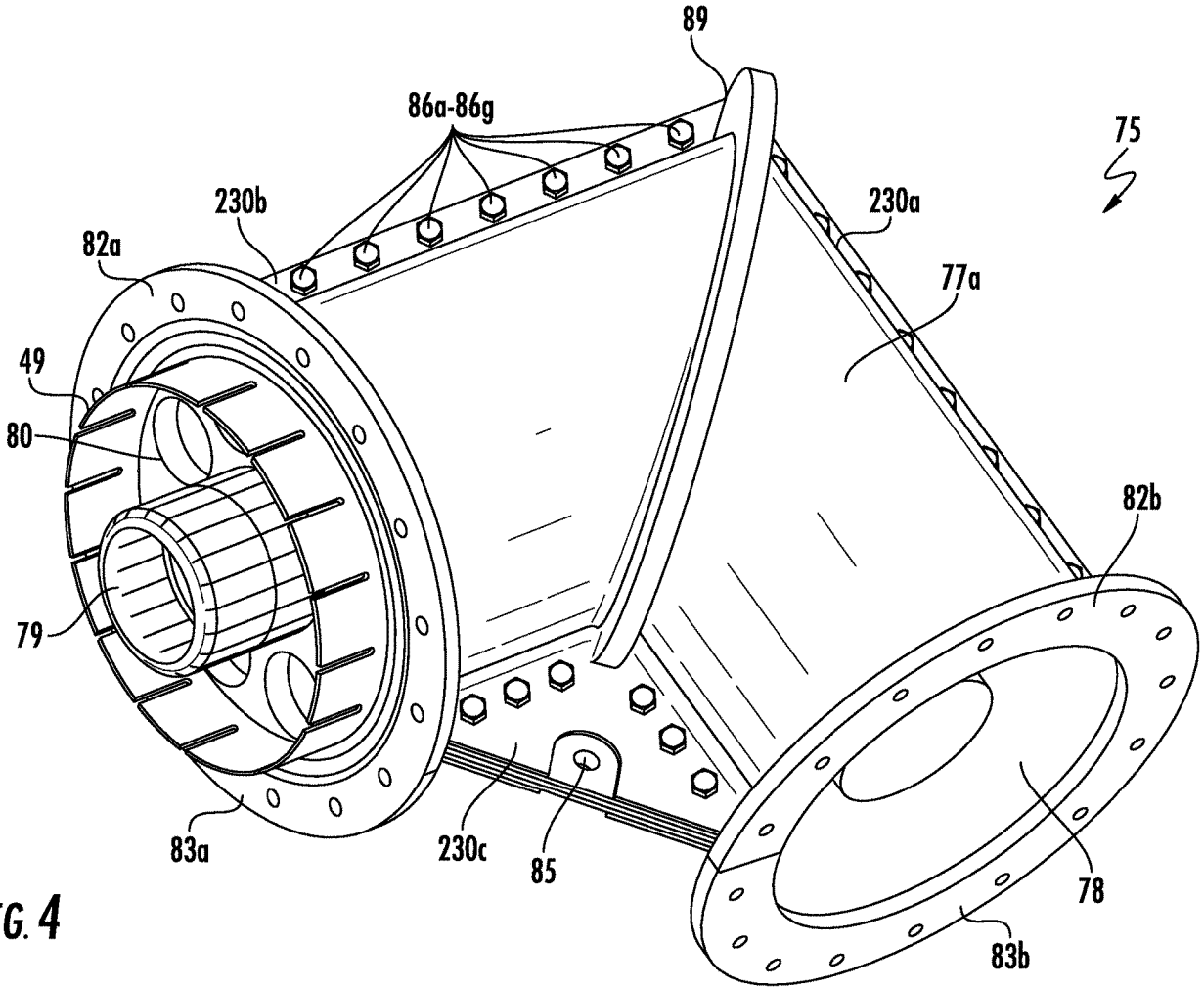
FIG. 4 is a perspective view of an elbow pressure member from the hydrocarbon resource recovery system of FIG.
Figure 5:
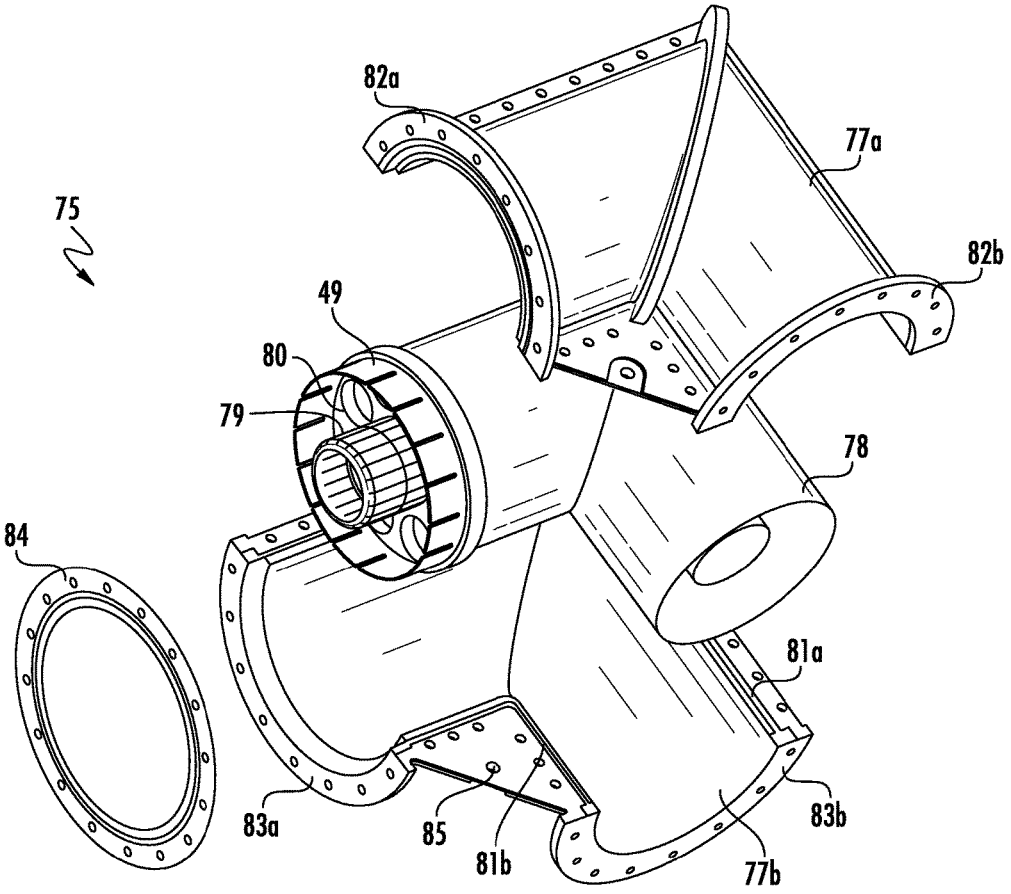
FIG. 5 is an exploded view of the elbow pressure member from the hydrocarbon resource recovery system of FIG. 1.
Figure 6:
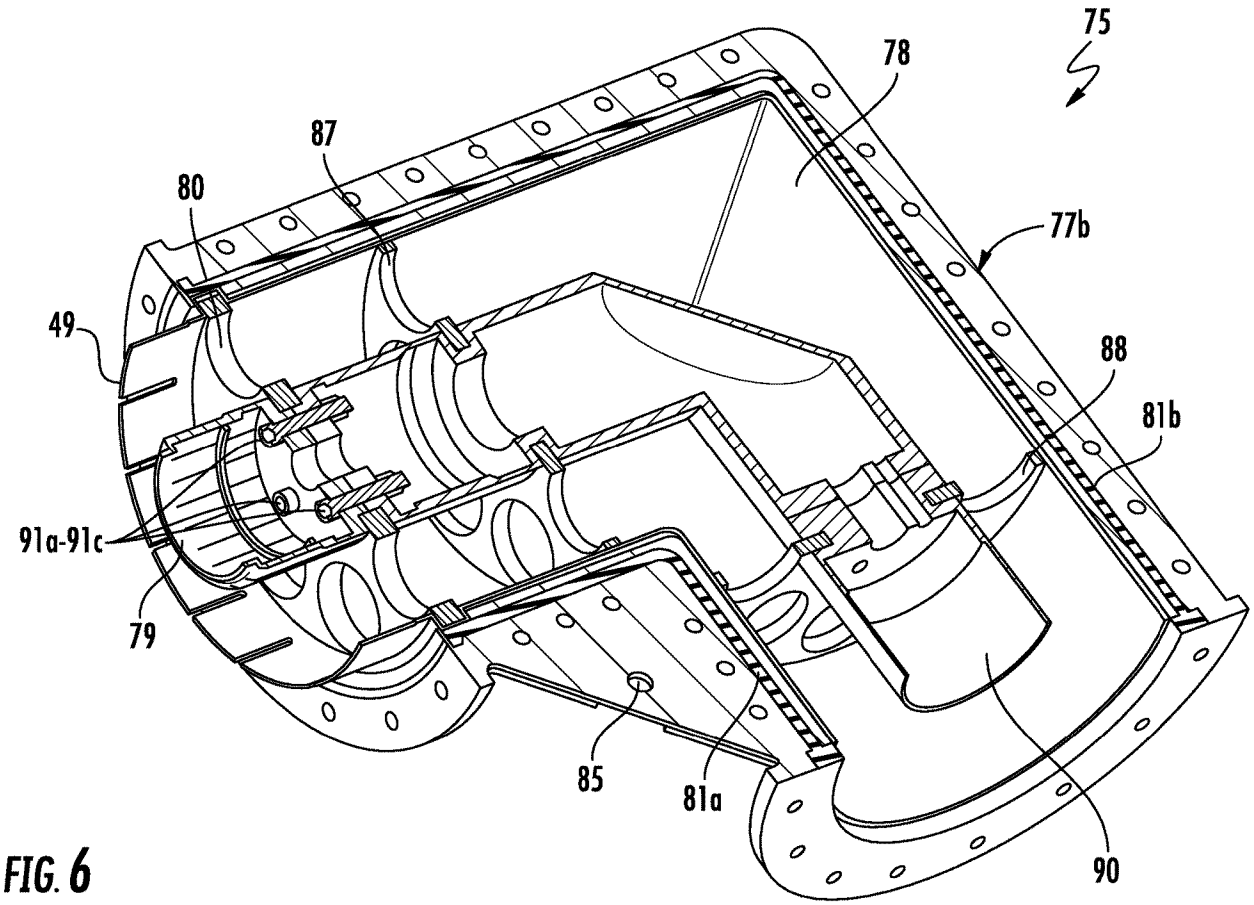
FIG. 6 is a perspective view of the elbow pressure member from the hydrocarbon resource recovery system of FIG. 1 with an upper half removed.
Figure 7:
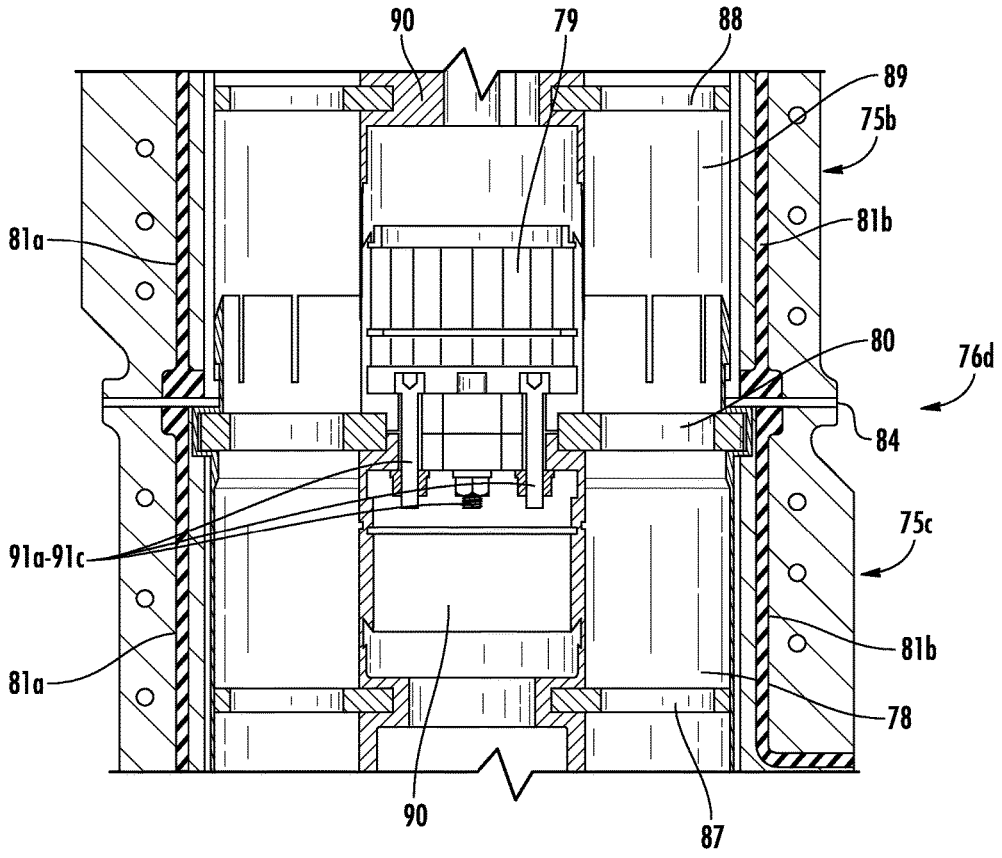
FIG. 7 is a top plan view of a flanged joint between adjacent elbow pressure members from the hydrocarbon resource recovery system of FIG. 1.
Figure 8:
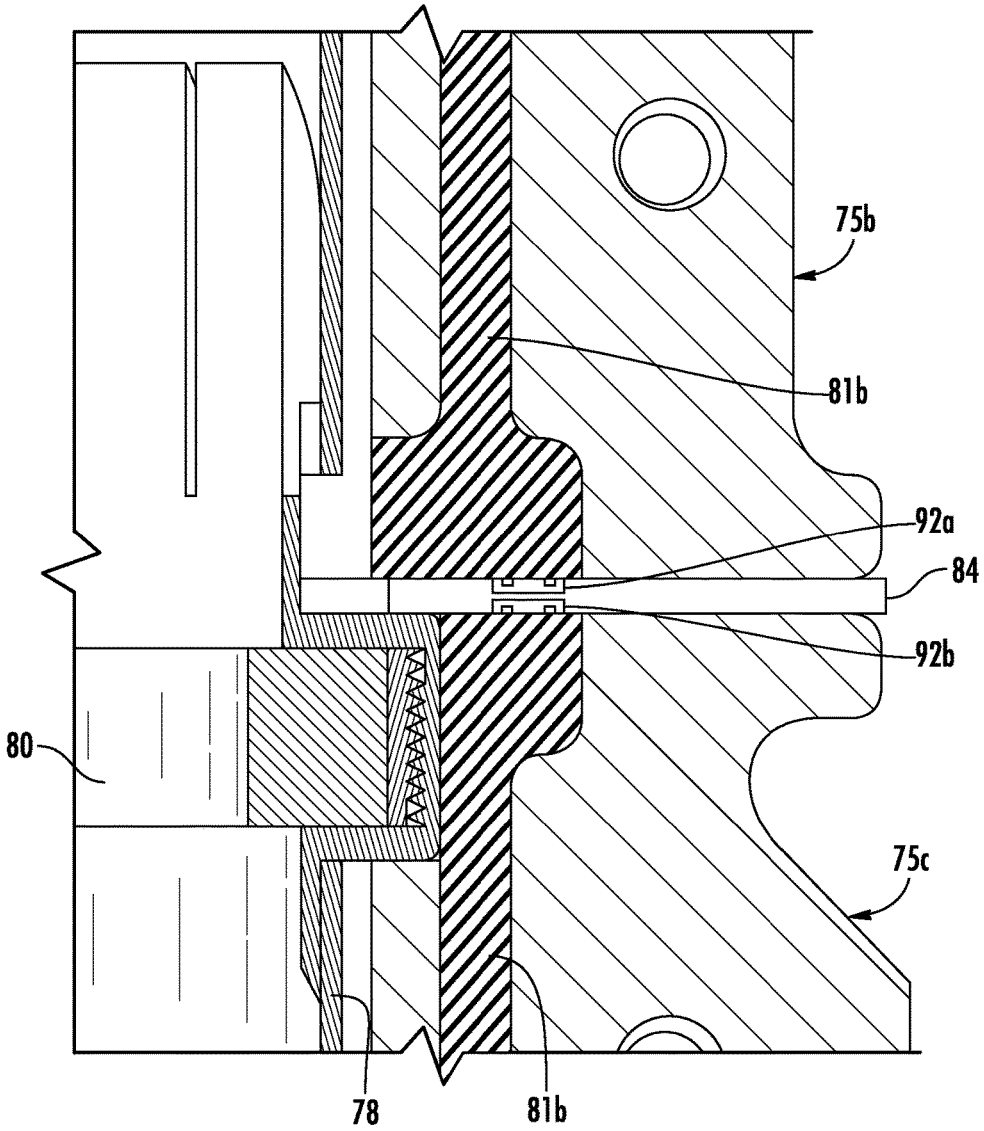
FIG. 8 is an enlarged top plan view of the flanged joint between the adjacent elbow pressure members from the hydrocarbon resource recovery system of FIG. 1.

Referring to FIGS. 1-3, a hydrocarbon resource recovery system 60 according to the present disclosure is now described. The hydrocarbon resource recovery system 60 illustratively is installed adjacent and within a subterranean formation 73. The hydrocarbon resource recovery system 60 illustratively includes an RF antenna 65 within a first wellbore 71 of the subterranean formation 73 for hydrocarbon resource recovery, and an RF source 62 aboveground (i.e. on a surface of the subterranean formation 73). The RF antenna 65 illustratively includes first and second tubular conductors 66, 68, and a dielectric isolator 67 coupled between the first and second tubular conductors to define a dipole antenna element.

The hydrocarbon resource recovery system 60 illustratively includes a coaxial RF transmission line 64 coupled between the RF antenna 65 and the RF source 62 and having an aboveground portion extending along the surface of the subterranean formation 73. The coaxial RF transmission line 64 also includes a belowground portion extending within the first wellbore 71.

The hydrocarbon resource recovery system 60 illustratively includes a dielectric fluid pressure source 61, and a plurality of pressure members joined 74*a*-74*d*, 75*a*-75*c* together in end-to-end relation to define a pressure housing 63 coupled to the dielectric fluid pressure source and surrounding the aboveground portion of the coaxial RF transmission line 64. In some advantageous embodiments, the dielectric fluid pressure source 61 may integrate a cooling feature to cool and recirculate the dielectric fluid.

The RF power source 62 may have a power level of greater than one megawatt (e.g. 1-20 megawatts). The plurality of pressure members 74*a*-74*d*, 75*a*-75*c* illustratively includes a plurality of straight tubular pressure members 74*a*-74*d* and a plurality of elbow pressure members 75*a*-75*c* coupled thereto. The hydrocarbon resource recovery system 60 illustratively includes a producer well 69 within a second wellbore 72 of the subterranean formation 73, which produces hydrocarbons.

The hydrocarbon resource recovery system 60 illustratively includes flanged joints 76*a*-76*e* between adjacent pressure members 74*a*-74*d*, 75*a*-75*c*. As shown in the illustrated embodiment, the flanged joints 76*a*-76*e* include a plurality of fasteners, such as a bolts, and may include additionally or alternatively welding.

As perhaps best seen in FIGS. 4-8, each elbow pressure member 75*a*-75*c* illustratively includes upper and lower longitudinal halves 77*a*-77*b* having respective opposing longitudinal flanges 230*a*-230*c* joined together via a plurality of fasteners 86*a*-86*g*. Each elbow pressure member 75*a*-75*c* illustratively includes a sealing strip 81*a*-81*b* extending along the opposing longitudinal flanges. Also, each elbow pressure member 75*a*-75*c* illustratively includes an outer conductor segment 78, and an outer conductor connector 80 coupled thereto. Each elbow pressure member 75*a*-75*c* illustratively includes an inner conductor segment 90, an inner conductor connector 79 coupled to the inner conductor segment, and a plurality of dielectric spacers 80, 87, 88 carrying the inner conductor segment 90 within the outer conductor segment 78. Each elbow pressure member 75*a*-75*c* illustratively includes a plurality of fasteners 91*a*-91*c* coupling together the inner conductor segment 90 and the inner conductor connector 79.

In another embodiment, each elbow pressure member 75*a*-75*c* could be formed as a single piece, i.e. without the upper and lower longitudinal halves 77*a*-77*b*. For example, the outer body of each elbow pressure member 75*a*-75*c* may be forged, and the outer conductor liner can be electroplated on the inner surface of the forged piece, or hydroformed on the forged piece.

As shown, each elbow pressure member 75*a*-75*c* includes opposing longitudinal flanges 82*a*-82*b*, 83*a*-83*b* for defining the respective flanged joints 76*a*-76*e* with female and male conductor mating ends. Each elbow pressure member 75*a*-75*c* illustratively includes an O-ring seal 84 carried by the male interface end, and a plurality of lift points 85, 89 configured to permit easy installation of the elbow pressure member. As perhaps best seen in FIG. 8, the O-ring seal 84 illustratively includes a plurality of gasket seal components 92*a*-92*b*.

Figure 9:
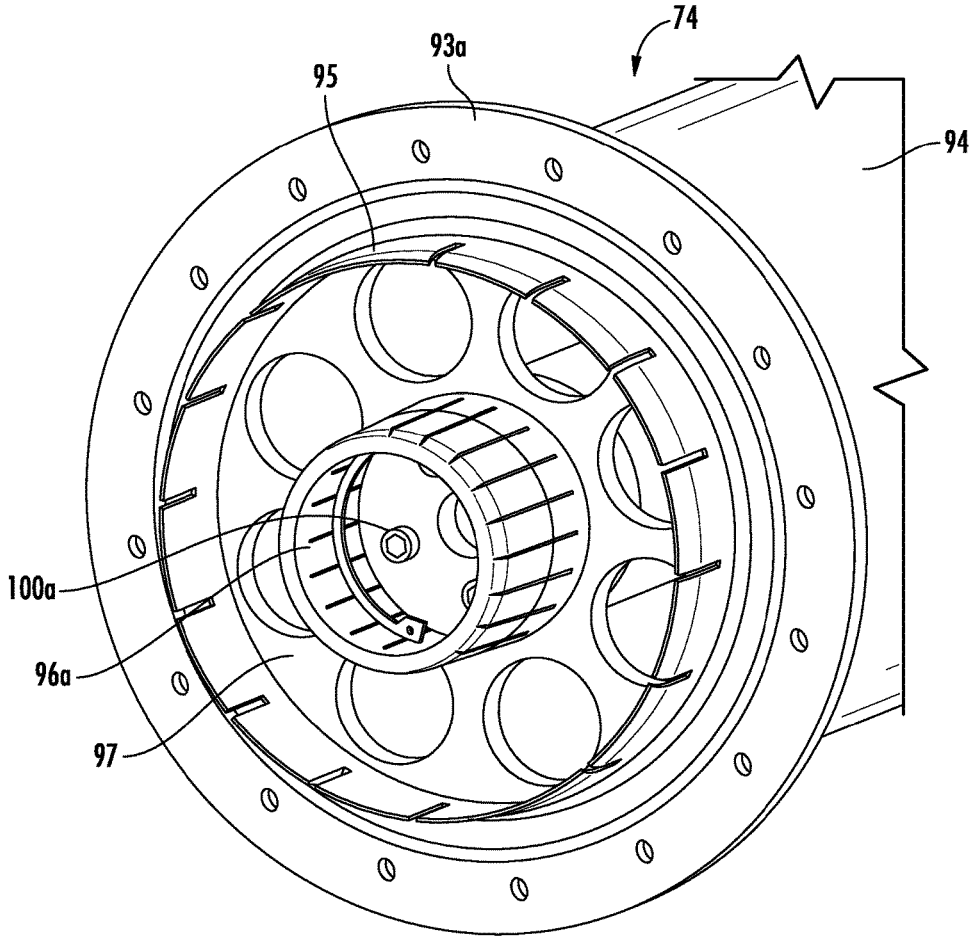
FIG. 9 is a perspective view of an end of a straight tubular pressure member from the hydrocarbon resource recovery system of FIG. 1.
Figure 10:
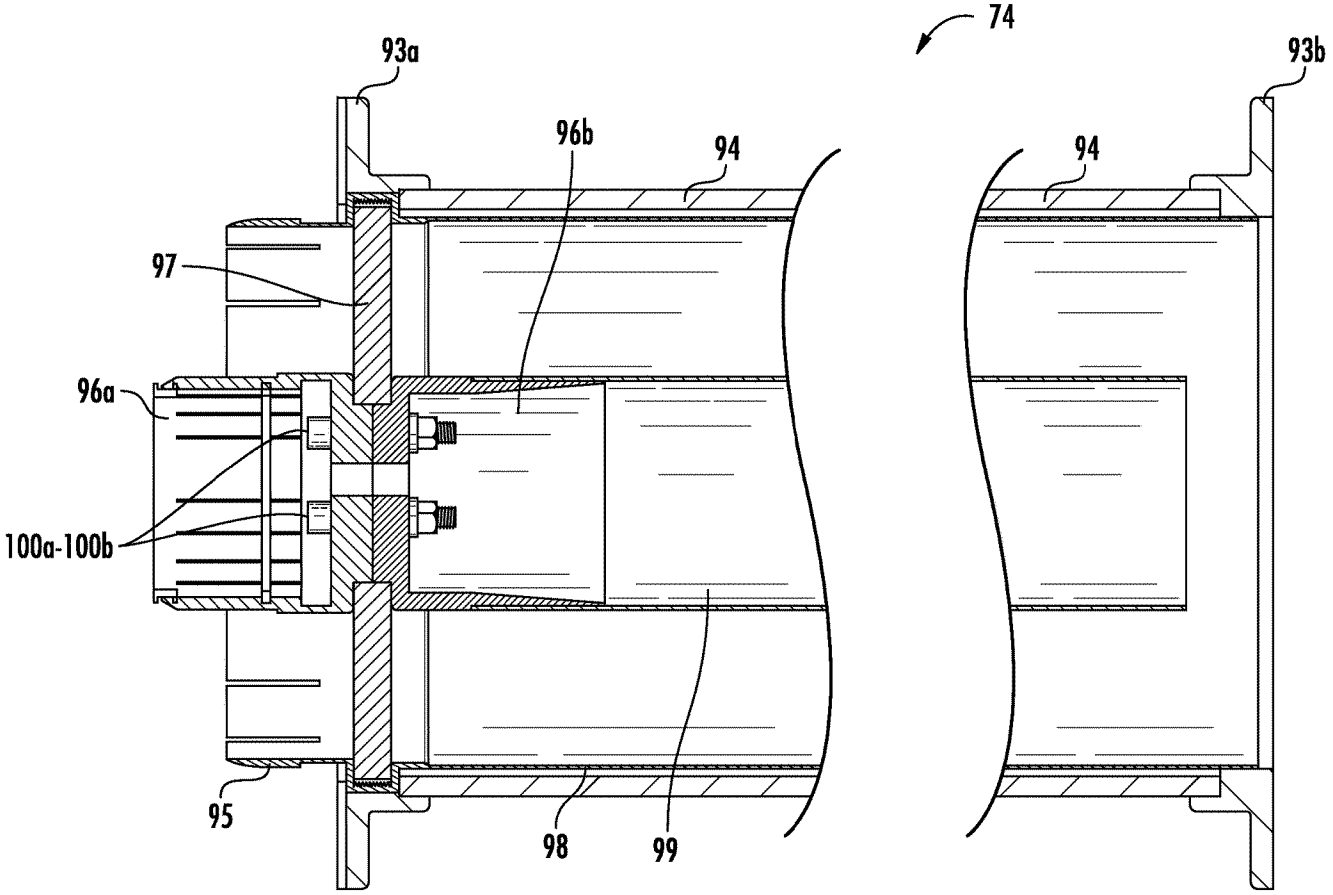
FIG. 10 is a cross-sectional view of the straight tubular pressure member from the hydrocarbon resource recovery system of FIG. 1.
Figure 11:
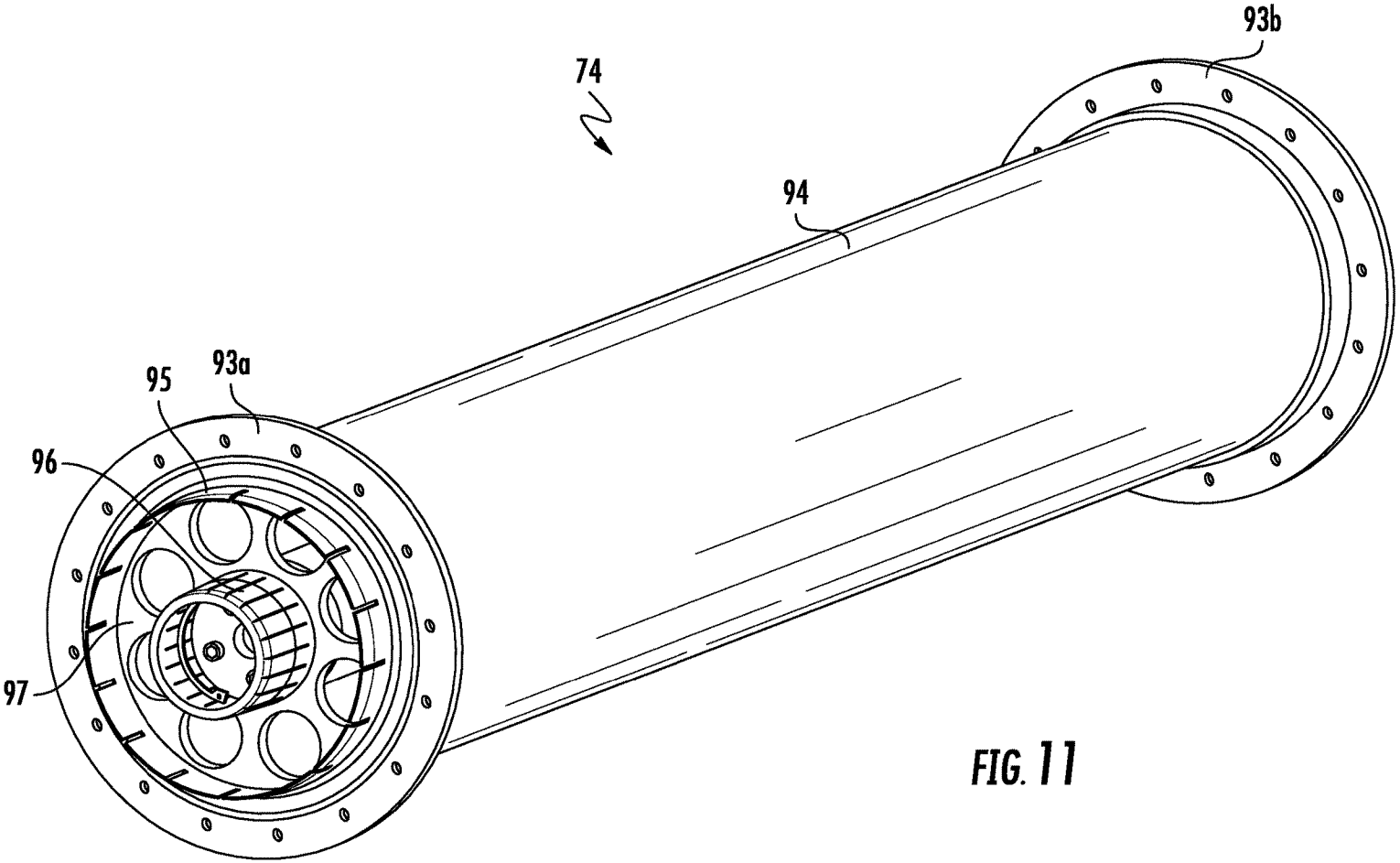
FIG. 11 is a perspective view of the straight tubular pressure member from the hydrocarbon resource recovery system of FIG. 1.

Referring additionally now to FIGS. 9-11, each of the plurality of straight tubular pressure members 74*a*-74*d* illustratively includes a tubular housing 94, flanged ends 93*a*-93*b* at opposing ends of the tubular housing, and an outer conductor segment 98 carried by the tubular housing. In the illustrated embodiment, the outer conductor segment 98 and the tubular housing 94 are spaced apart to facilitate assembly (e.g. nominal air gap of 0.02-1 inches). In another embodiment, the outer conductor segment 98 and the tubular housing 94 may directly contact each other. Also, each of the plurality of straight tubular pressure members 74*a*-74*d* illustratively includes an inner conductor segment 99, first and second inner conductor connectors 96*a*-96*b* coupled to the inner conductor segment, a plurality of fasteners 100*a*-100*b* coupling the first and second inner conductor connectors together, and an outer conductor connector 95 coupled to the outer conductor segment 98, and a dielectric spacer 97 carried by the outer conductor spacer.

The coaxial RF transmission line 64 illustratively includes a first metal having a first strength, and the pressure housing 63 (i.e. the tubular housing 94 and the upper and lower longitudinal halves 77*a*-77*b*) illustratively includes a second metal having a second strength greater than the first strength. In some embodiments, the first metal has a first electrical conductivity, and the second metal has a second electrical conductivity less than the first electrical conductivity. For example, the first metal may include one or more of copper, aluminum, or beryllium copper, and the second metal may include steel. Also, the pressure housing 63 illustratively has a pressure rating of at least 100 pounds per square inch (psi).

Aboveground, the coaxial RF transmission line 64 is defined by the inner conductor segments 90, 99 and the outer conductor segments 78, 98, and the dielectric fluid pressure source 61 is configured to circulate pressurized dielectric fluid between the inner conductor segments 90, 99 and the outer conductor segments 78, 98. The pressurized dielectric fluid may include a pressurized gas, for example, $N_2$, $CO_2$, or $SF_6$.

Belowground, the coaxial RF transmission line 64 is defined by inner conductor segments and outer conductor segments (not shown), and is filled with a dielectric fluid (e.g. mineral oil). The hydrocarbon resource recovery system 60 includes an IOB device at the wellhead and configured to manage the transition from the liquid cooled RF transmission line 64 underground to the gas filled RF transmission line 64 aboveground.

Another aspect is directed to a hydrocarbon resource recovery component in a hydrocarbon resource recovery system 60 for a subterranean formation 73. The hydrocarbon resource recovery system 60 illustratively includes an RF antenna 65 within the subterranean formation 73 for hydrocarbon resource recovery, an RF source 62 aboveground, and a dielectric fluid pressure source 61. The hydrocarbon resource recovery component illustratively includes a coaxial RF transmission line 64 coupled between the RF antenna 65 and the RF source 62 and having an aboveground portion, and a plurality of pressure members 74*a*-74*d*, 75*a*-75*c* joined together in end-to-end relation to define a pressure housing 63 coupled to the dielectric fluid pressure source 61 and surrounding the aboveground portion of the coaxial RF transmission line. The plurality of pressure members 74*a*-74*d*, 75*a*-75*c* illustratively includes at least one straight tubular pressure member 74*a*-74*d*, and at least one elbow pressure member 75*a*-75*c* coupled thereto.

Another aspect is directed to a method for assembling a hydrocarbon resource recovery system 60 for a subterranean formation 73. The method comprises positioning an RF antenna 65 within the subterranean formation 73 for hydrocarbon resource recovery, positioning an RF source 62 aboveground, and coupling a coaxial RF transmission line 64 between the RF antenna and the RF source and having an aboveground portion. The method comprises coupling a plurality of pressure members 74*a*-74*d*, 75*a*-75*c* joined together in end-to-end relation to define a pressure housing 63 coupled to a dielectric fluid pressure 61 source and surrounding the aboveground portion of the coaxial RF transmission line 64. The plurality of pressure members 74*a*-74*d*, 75*a*-75*c* comprises at least one straight tubular pressure member 74*a*-74*d*, and at least one elbow pressure member 75*a*-75*c* coupled thereto.

Figure 12:
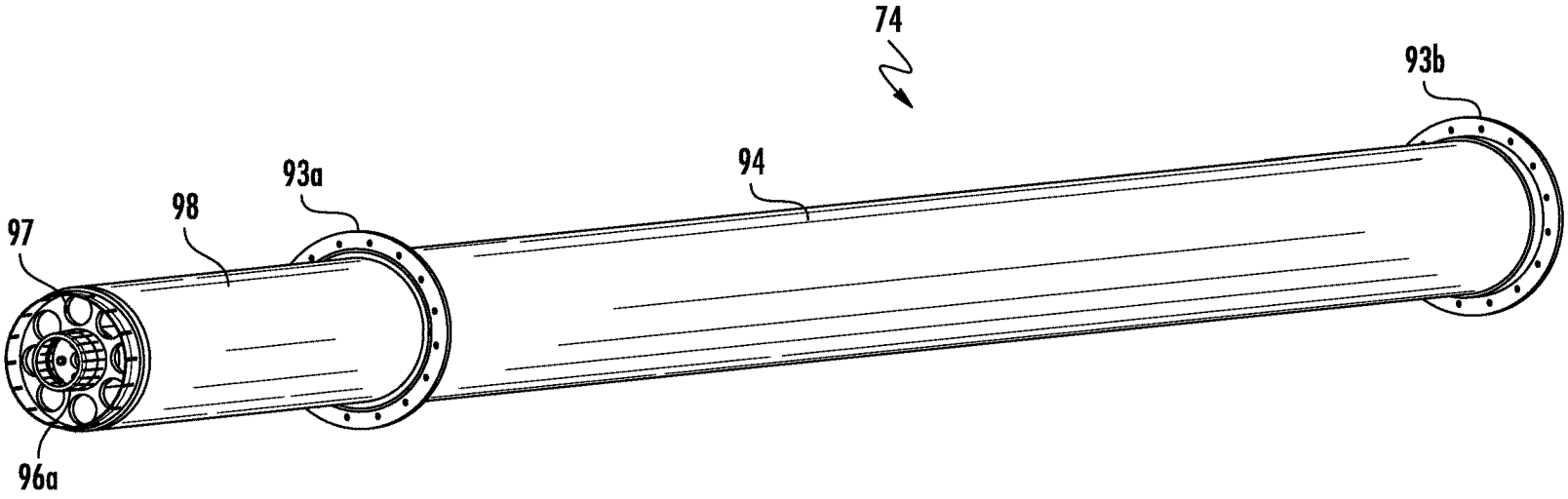
FIG. 12 is a perspective view of the straight tubular pressure member from the hydrocarbon resource recovery system of FIG. 1 with the coaxial RF transmission line partially withdrawn during assembly.
Figure 13A:
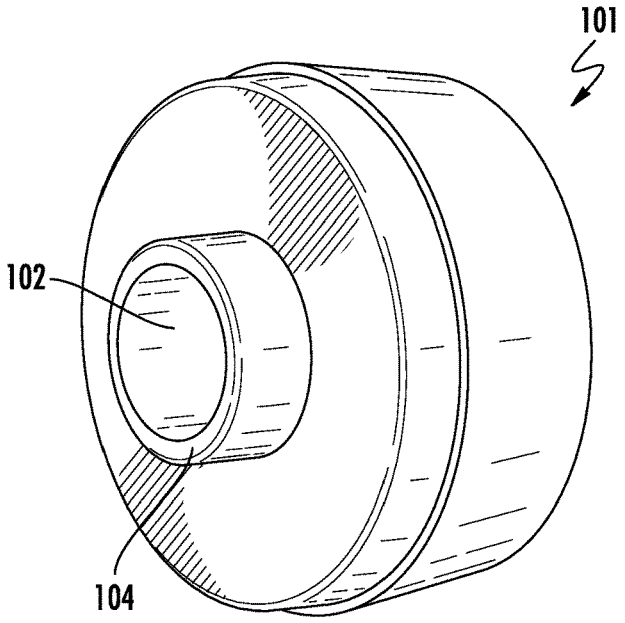
FIGS. 13A-13B are perspective views of a dielectric insertion plug for the straight tubular pressure member from the hydrocarbon resource recovery system of FIG. 1.
Figure 13B:
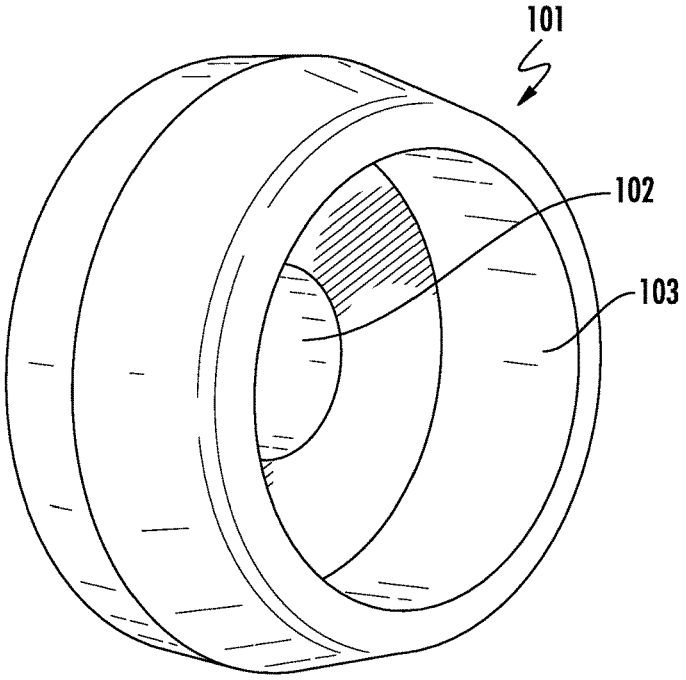
Figure 14B:
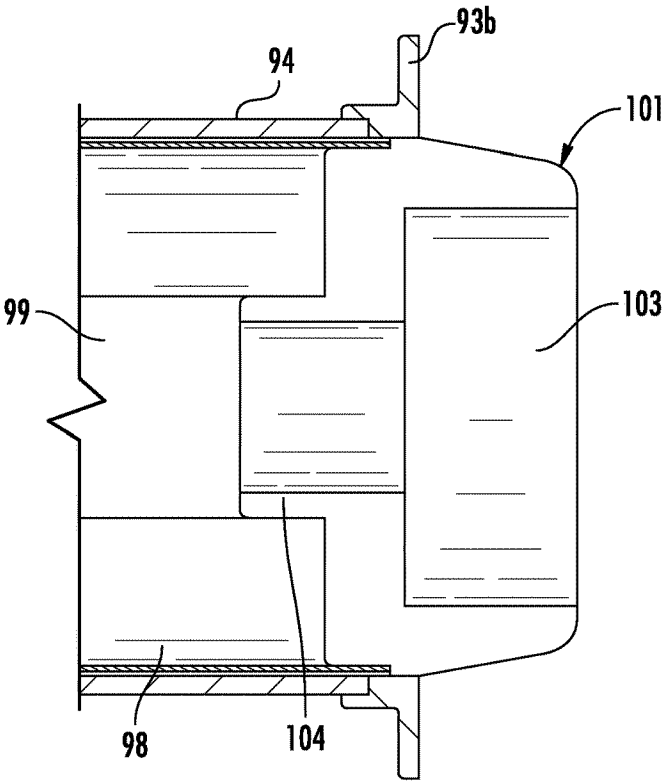
FIGS. 14A-14B are cross-sectional views of the dielectric insertion plug within the straight tubular pressure member from the hydrocarbon resource recovery system of FIG. 1.
Figure 14A:
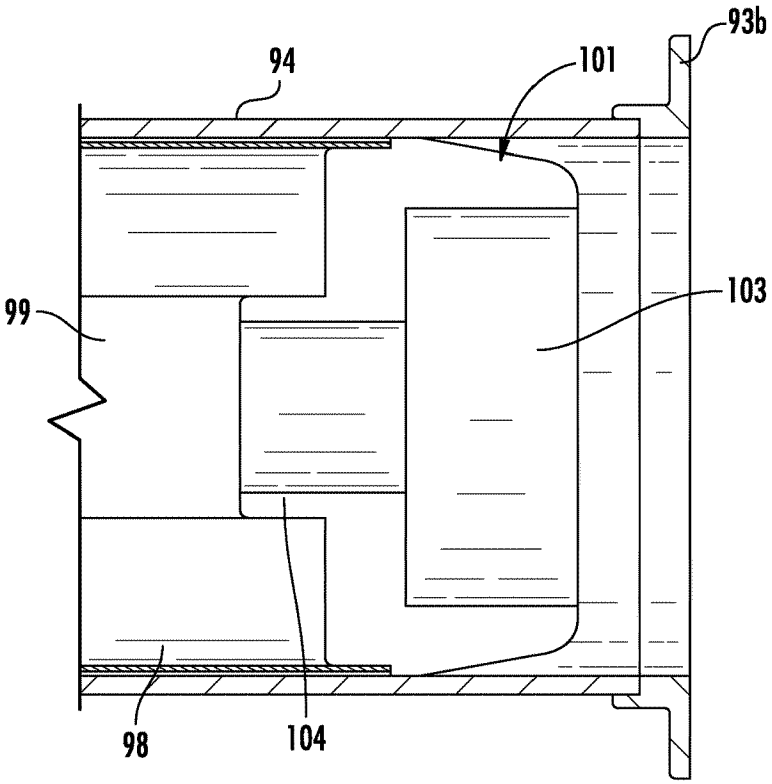
Figure 15A:
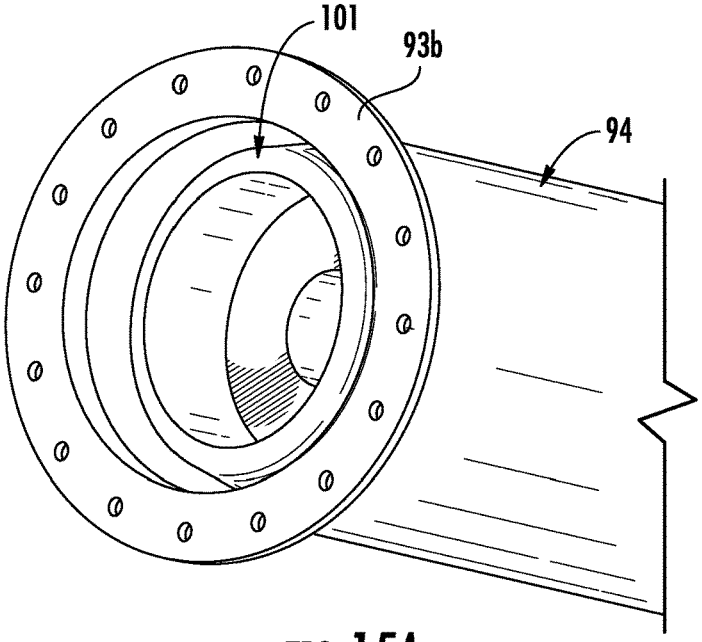
FIGS. 15A-15B are perspective views of the dielectric insertion plug within the straight tubular pressure member from the hydrocarbon resource recovery system of FIG. 1.
Figure 15B:
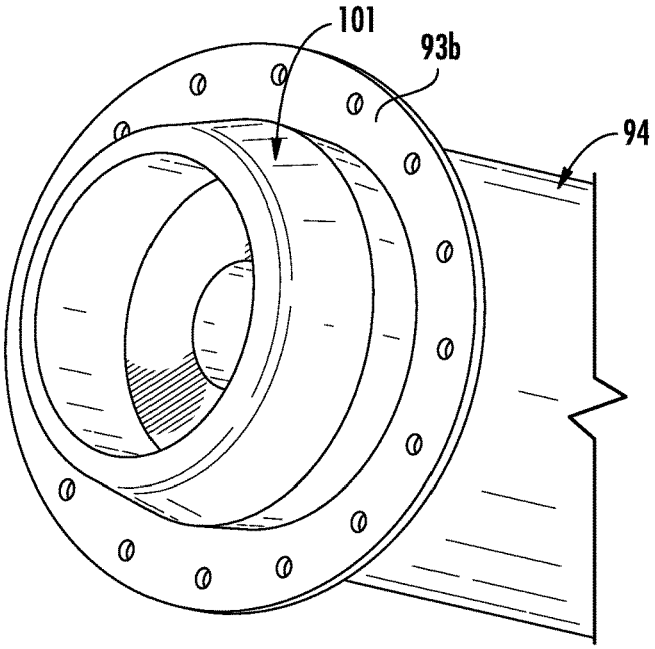
Figure 16:
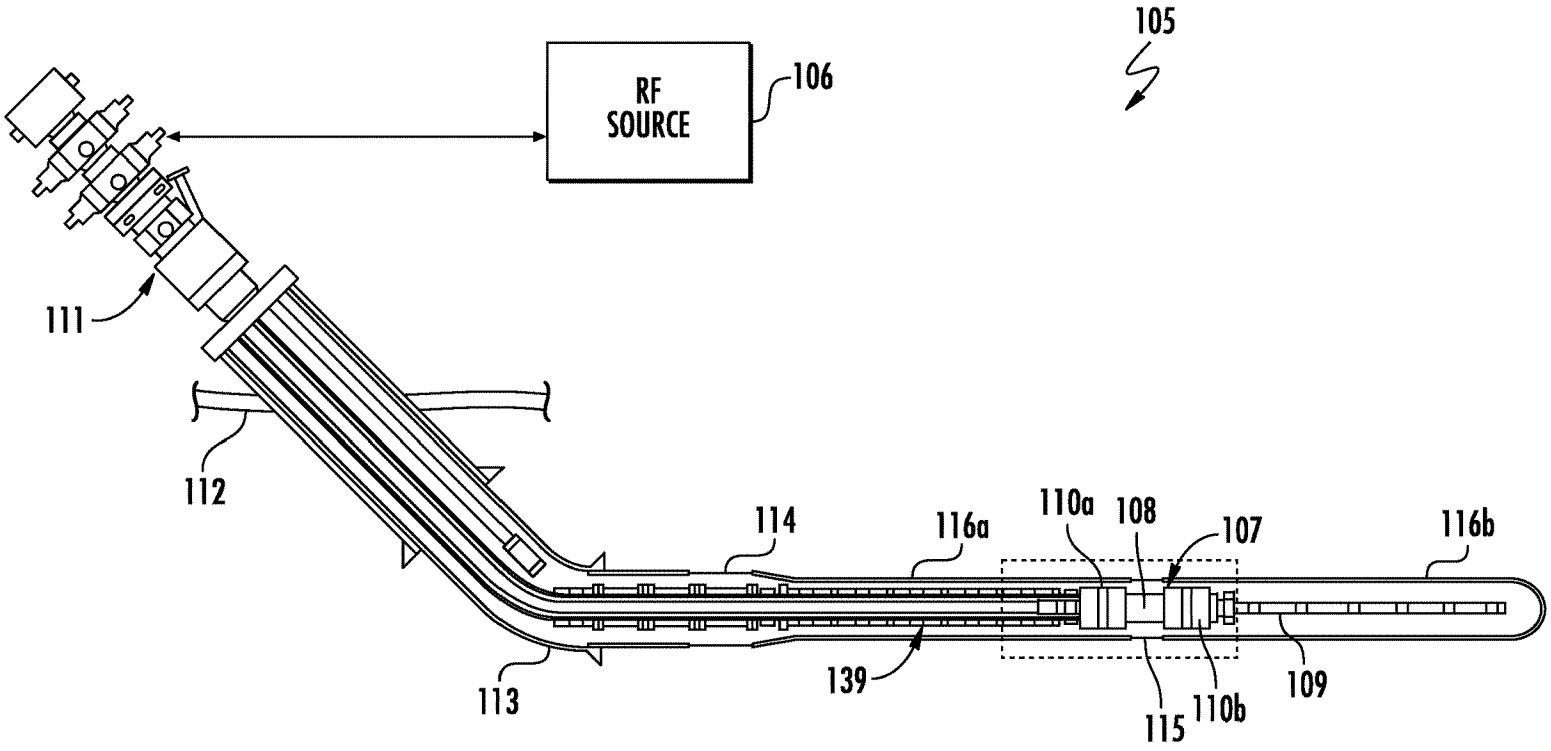
FIG. 16 is a schematic diagram of another embodiment of the hydrocarbon resource recovery system, according to the present disclosure.

Referring now additionally to FIGS. 12-15B, the steps for assembling each of the plurality of straight tubular pressure members 74*a*-74*d* are described. In FIGS. 12 & 14A-14B, the coaxial RF transmission line 64 is installed into the tubular housing 94 while using an installation plug 101 as a centralizer guide. The installation plug 101 illustratively includes a central protrusion 104 defining a passageway 102 and carrying the inner conductor segment 99 as the coaxial RF transmission line 64 is positioned within the tubular housing 94. The installation plug 101 illustratively includes a peripheral edge 103 configured to abut inner portions of the outer conductor segment 98 during installation.

As will be appreciated, during a typical hydrocarbon resource recovery operation, the aboveground portion of the operation is quite complicated and intricate (e.g. complicated by routing of power, fluids, produced hydrocarbons). Indeed, the path for the coaxial RF transmission line 64 is far from a straight line path. Advantageously, the hydrocarbon resource recovery system 60 includes both straight tubular pressure members 74*a*-74*d* and elbow pressure members 75*a*-75*c*, which can be rotated before assembly to permit intricate paths, as perhaps best seen in FIGS. 2-3. Indeed, the example shown in the illustrated embodiment is merely one of many possible arrangements. Moreover, the pressure housing 63 provides a mechanically strong body for carrying pressurized dielectric fluid.

Indeed, in typical approaches, the pressurized dielectric fluid is pumped into a typical coaxial RF transmission line, and the corresponding pressure (typically 15 psi) is limited by the mechanical strength of the outer conductor and respective weld joints between segments. This is due to the annealing of the metal at the welding joints made from aluminum and copper, which are desirable electrical conductors. Moreover, these materials have scrap value and have increased theft rates at secluded sites. In the hydrocarbon resource recovery system 60, the outer conductor no longer is a limit to pressure, and the dielectric fluid pressure source 61 is configured to pressurize the dielectric fluid at within a range of 100-500 psi.

The advantage of this greater pressure is that the RF source 62 can operate at greater power levels without commensurate increases in the size of the coaxial RF transmission line 64 (usually done to achieve high voltage standoff safety requirements). In other words, with the high pressure dielectric fluid between the inner and outer conductors in the hydrocarbon resource recovery system 60, the power level can be safely increased without changing out the coaxial RF transmission line 64 (commonly done between start-up and sustainment phases), which reduces operational costs.

Moreover, the high pressure dielectric fluid keeps moisture out of the system and reduces risk of corrosion, and provides a medium with greater thermal conductivity. Indeed, since the pressure housing 65 components are made from corrosion resistant stainless steel, in some embodiments, the internal sensitive components are protected from the external environment. In short, the pressure housing 65 and the coaxial RF transmission line 64 therein of the disclosed hydrocarbon resource recovery system 60 provide for a more rugged, and more flexible platform for RF heating with the RF antenna 65.

Referring now to FIGS. 16-24, another embodiment of a hydrocarbon resource recovery system 105 according to the present disclosure is now described. The hydrocarbon resource recovery system 105 illustratively includes an RF source 106, and an RF antenna assembly 107 coupled to the RF source and within a wellbore 113 in a subterranean formation 112 for hydrocarbon resource recovery. The RF antenna assembly 107 illustratively includes first and second electrical contact sleeves 110*a*-110*b*, first and second tubular conductors 116*a*-116*b* respectively coupled to the first and second electrical contact sleeves, and a dielectric isolator 115 coupled between the first and second tubular conductors.

The RF antenna assembly 107 illustratively includes a dielectric coupler 108 between the first and second electrical contact sleeves 110*a*-110*b*, a distal guide string 109 coupled to the second electrical contact sleeve, and an RF transmission line 139 comprising an inner conductor (e.g. one or more of beryllium copper, copper, aluminum) 140 and an outer conductor (e.g. one or more of beryllium copper, copper, aluminum) 141 extending within the first tubular conductor 116*a*. The outer conductor 141 is coupled to the first tubular conductor 116*a*. The RF antenna assembly 107 illustratively includes a feed structure 122 coupled to the second tubular conductor 116*b*. The RF antenna assembly 107 illustratively includes a heel isolator 114 coupled to the first tubular conductor 116*a*.

Figure 18:
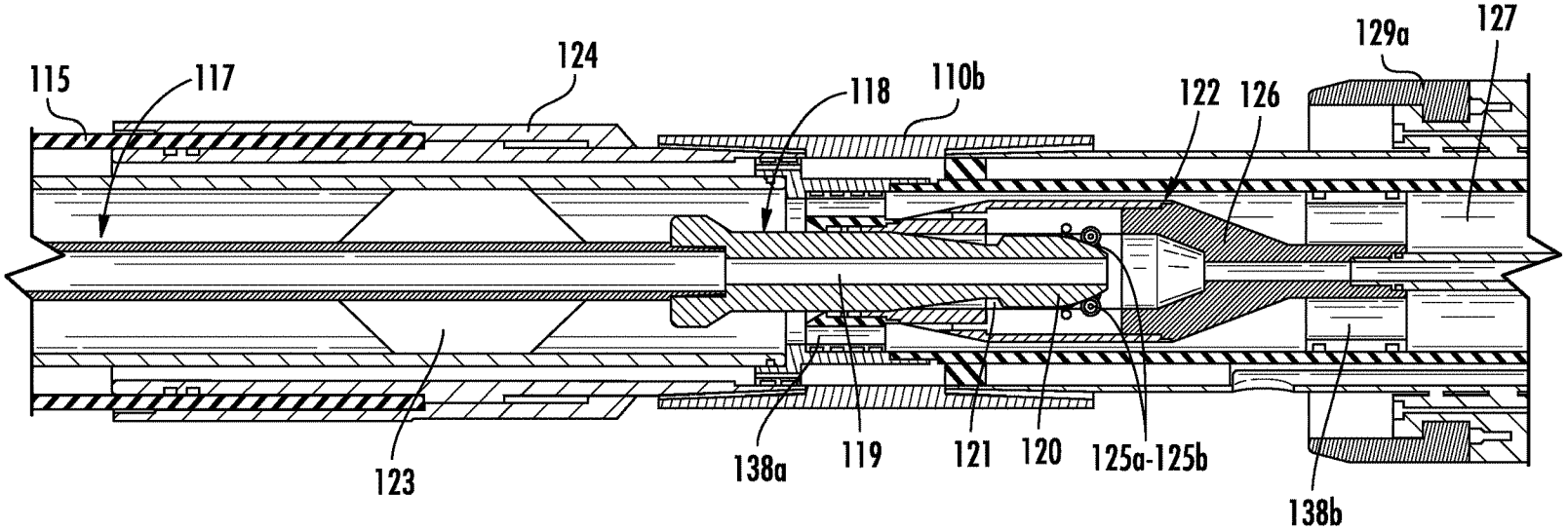
Figure 24:
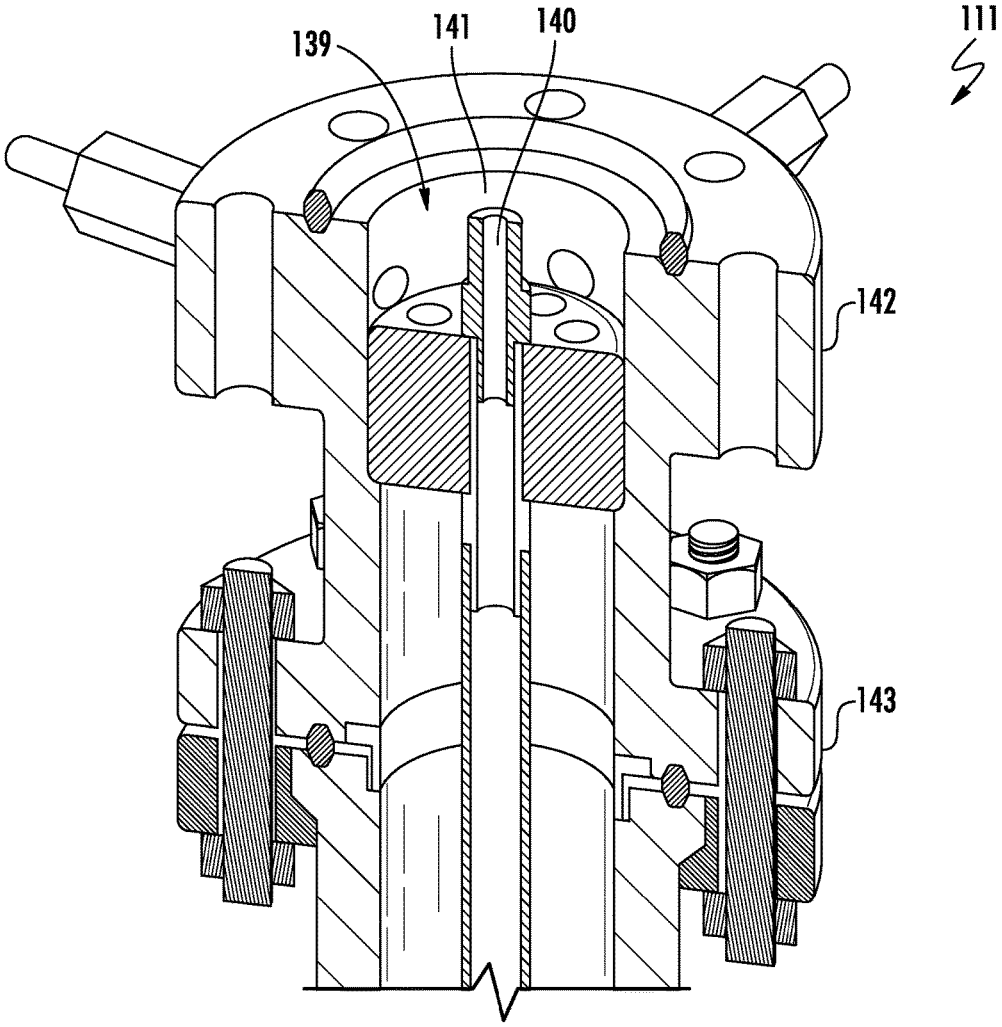
FIG. 24 is a cross-sectional view of a wellhead from the hydrocarbon resource recovery system of FIG. 16.
Figure 25:
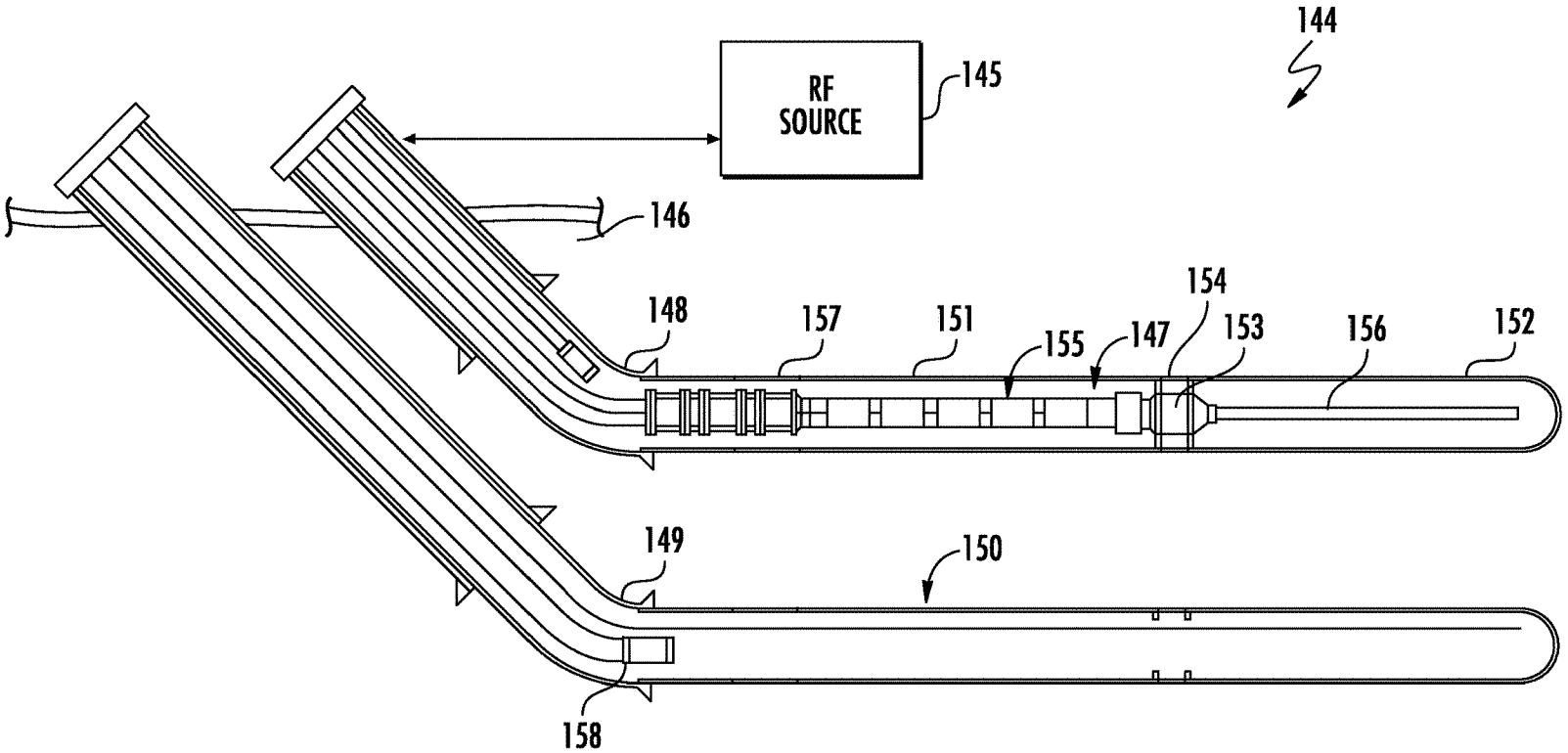
FIG. 25 is a schematic diagram of yet another embodiment of the hydrocarbon resource recovery system, according to the present disclosure.
Figure 26:
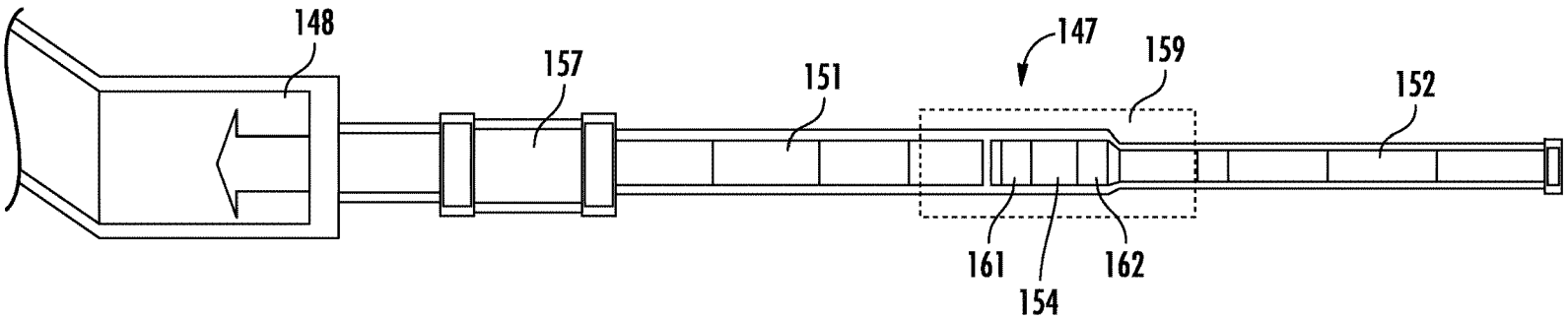
FIG. 26 is a schematic diagram of an RF antenna assembly from the hydrocarbon resource recovery system of FIG. 25.

The inner conductor 140 illustratively has a distal end 117 being slidable within the outer conductor 141 and cooperating with the feed structure 122 to define a latching arrangement having a latching threshold (e.g. 100 lb.) lower than an unlatching threshold (e.g. >3,000 lb.). The hydrocarbon resource recovery system 105 illustratively includes a wellhead 111 on a surface of the subterranean formation 112. After installation of the inner conductor 140, the inner conductor string is hung on the wellhead 111 via hanger components 142-143 (FIG. 24). Hence, the unlatching threshold is greater than a hanging weight of the inner conductor string. In other words, the inner conductor string is tensioned in a preloaded state, as shown in FIG. 18. In particular, the unlatching threshold is adjusted so that it is at least 10% (or greater) of the string weight, permitting the inner conductor can be tensioned slightly higher than the string weight.

In the illustrated embodiment, the distal end 117 of the inner conductor 140 comprises a plug body 118 having a tapered front end 120, a radial recess 121 spaced therefrom, and a flanged back end 132 defining a "no-go feature". The tapered front end 120 illustratively has a slope being shallower than a slope of the radial recess 121. The plug body 118 defines a passageway (e.g. for a fluid passageway or a thermal probe access point) 119 extending therethrough.

Also, the feed structure 122 illustratively includes a receptacle body 126 configured to receive the plug body 118, and a plurality of biased roller members carried by the receptacle body and configured to sequentially engage the tapered front end 120 and the radial recess 121 of the plug body 118. Each biased roller member illustratively includes a roller 125*a*-125*b*, an arm 134 having a proximal end pivotally coupled to the receptacle body 126 and a distal end carrying the roller, a pin 135 within the proximal end of the arm and permitting the arm to pivot, and a spring (e.g. Bellville spring) 136 configured to bias the proximal end of the arm. Each biased roller member illustratively includes a load adjustment screw 137, a spring interface 232 between the load adjustment screw and the spring 136, and a pawl plunger 231 configured to contact the proximal end of the arm 134.

As will be appreciated, the load adjustment screw 137 permits setting of the unlatching threshold. Before installation, the unlatching threshold is calculated so that preloading the inner conductor string can be accomplished without unintentional unlatching of the distal end 117 of the inner conductor 140.

Moreover, the receptacle body 126 is illustratively slidably moveable within the second tubular conductor 116*b* for accommodating thermal expansion of the inner conductor string. As perhaps best seen in FIG. 23, the feed structure 122 has a forward stop 126 configured to limit forward travel (during the latching process) of the distal end 117 of the inner conductor 140. The RF transmission line 139 illustratively includes a plurality of dielectric stabilizers 123*a*-123*b* supporting the inner conductor 140 within the outer conductor 141. Each of the plurality of dielectric stabilizers 123*a*-123*b* may comprise polytetrafluoroethylene (PTFE) material or other suitable dielectric materials.

Figure 17:
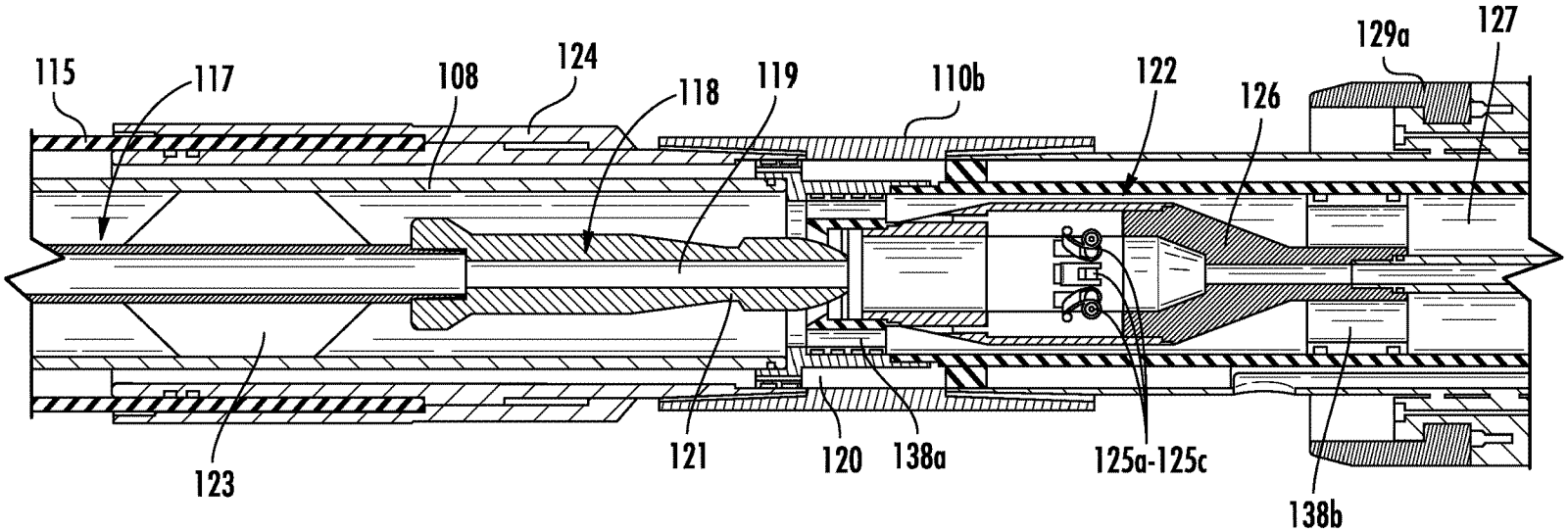
FIGS. 17-19 are cross-sectional views of a distal end of an inner conductor from the hydrocarbon resource recovery system of FIG. 16 during latching within a feed structure.
Figure 19:
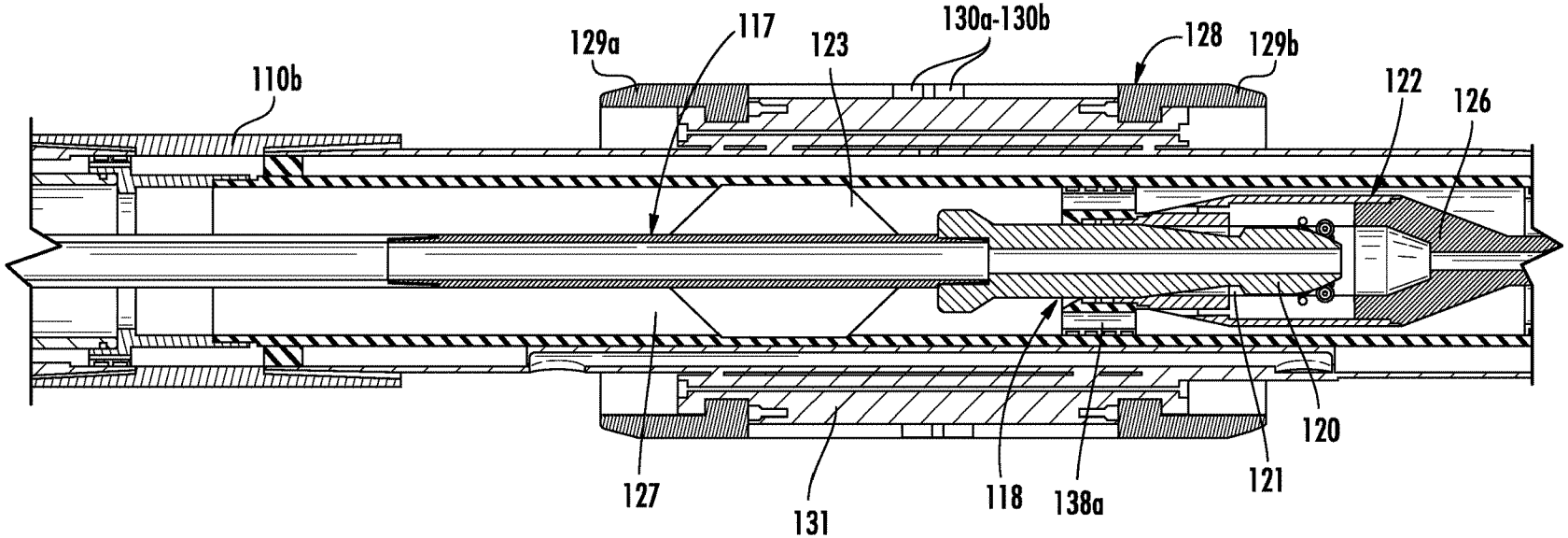

Referring now specifically to FIGS. 17-19, the RF antenna assembly 107 illustratively includes a tubular connector 124 coupled between the dielectric isolator 115 and the second electrical contact sleeve 110*b*. The feed structure 122 is electrically coupled to the second electrical contact sleeve 110*b*. During an RF heating operation, the inner conductor string heats up and elongates, pushing the receptacle body 126 downhole within the second tubular conductor 116*b*. The feed structure 122 illustratively includes a tubular connector 127 electrically coupled to the second tubular conductor 116*b*, and first and second electrical connector elements 138*a*-138*b* coupling the tubular connector to the second tubular conductor.

The RF antenna assembly 107 illustratively includes a centralizer 128 configured to position the second tubular conductor 116*b* within the wellbore 113. The centralizer 128 illustratively includes first and second opposing caps 129*a*-129*b*, a medial tubular coupler 131 coupled between the first and second opposing caps, and a plurality of watchband spring connectors 130*a*-130*b* carried by the medial tubular coupler.

Figure 20:
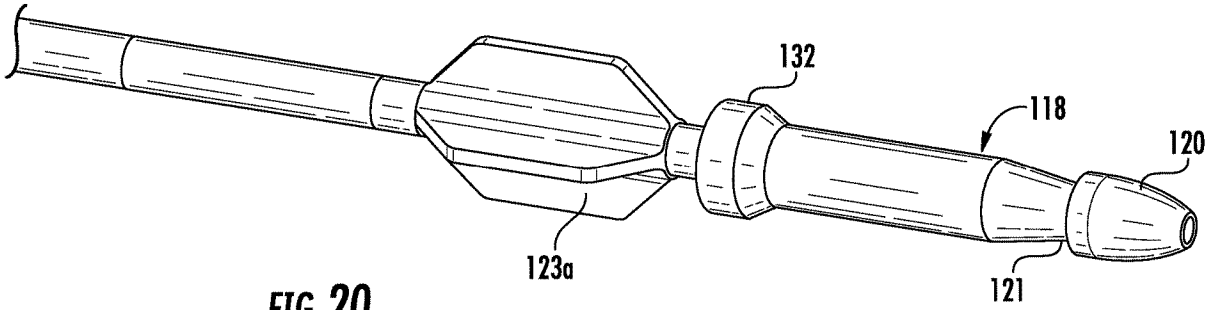
FIGS. 20-21 are perspective views of the distal end of the inner conductor from the hydrocarbon resource recovery system of FIG. 16.
Figure 21:
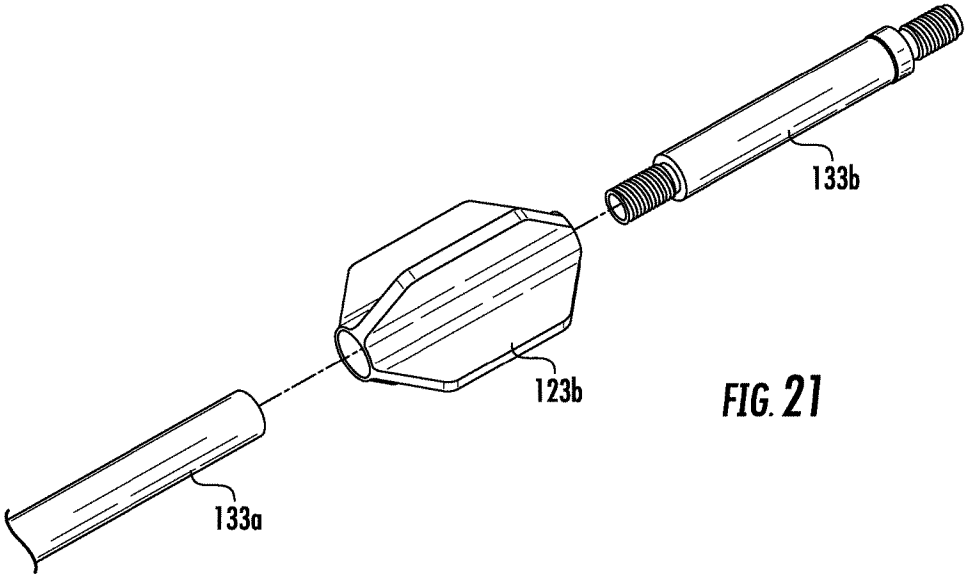
Figure 22:
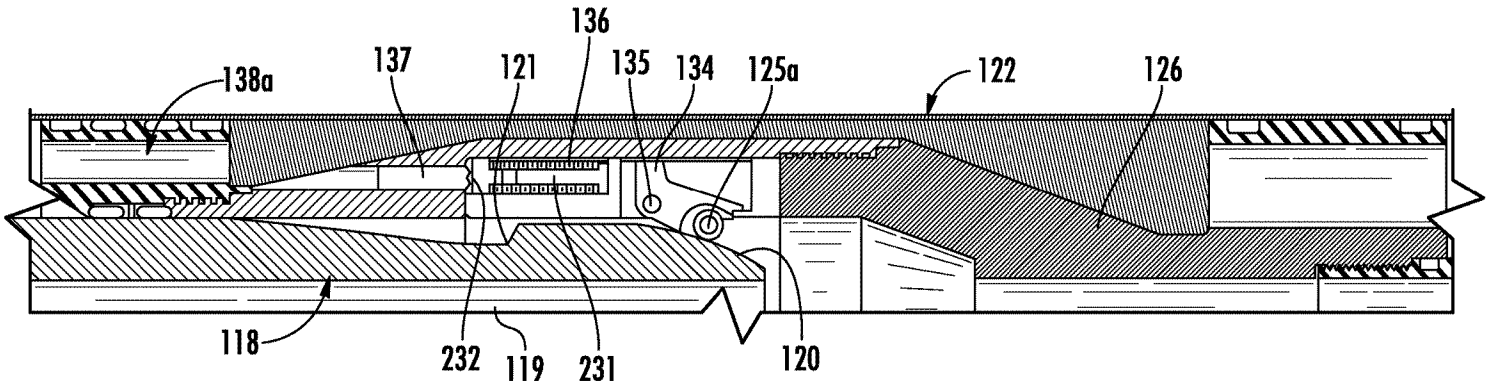
FIGS. 22-23 are cross-sectional views of a portion of the distal end of the inner conductor from the hydrocarbon resource recovery system of FIG. 16 during the latching within the feed structure.
Figure 23:
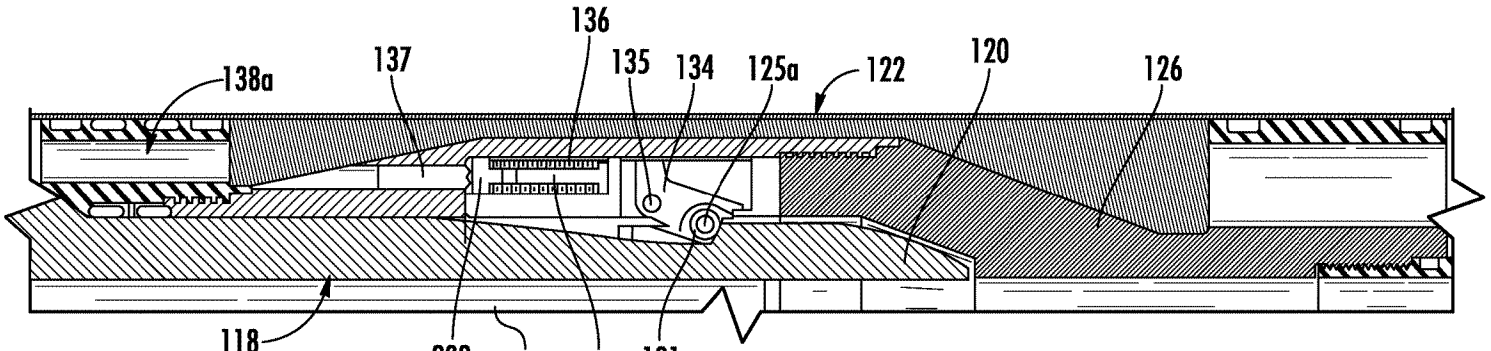

As seen in FIGS. 20-21, the inner conductor string is readily assembled onsite via threaded interfaces between adjacent inner conductor segments 133*a*-133*b*. The dielectric stabilizers 123*a*-123*b* may be slid on and captured, co-molded onto, or thermally expanded and slid over for seating on the inner conductor segments 133*a*-133*b*. In some embodiments, each inner conductor segment 133*a*-133*b* is bimetallic and comprises a higher conductivity outer layer (e.g. copper), and a lower conductivity inner layer (e.g. stainless steel, and/or steel). The outer layer may be hydroformed onto the inner layer, for example.

Advantageously, the hydrocarbon resource recovery system 105 permits the inner conductor string to be installed separately from the outer conductor string and the RF antenna assembly 107. Since the size and weight of the inner conductor string is much less (inner conductor segments 133*a*-133*b* being 1.167" outer diameter tube, 5' length), this is easier for onsite personnel. Furthermore, since the inner conductor string is a common failure point in typical use, the hydrocarbon resource recovery system 105 is readily repaired since the distal end 117 of the inner conductor 140 can be unlatched from the feed structure 122 and removed for subsequent replacement. In typical approaches, the entire RF antenna assembly string has to come out to replace the inner conductor. Because of the substantial cost in typical approaches, some wells may go abandoned when this occurs. Positively, the hydrocarbon resource recovery system 105 permits easy replacement of the inner conductor string.

Furthermore, since the feed structure 122 can accommodate thermal expansion of the inner conductor 140, the inner conductor is not damaged by thermal expansion. Indeed, this is a common cause of failure of the inner conductor string.

Another aspect is directed to an RF antenna assembly 107 for a hydrocarbon resource recovery system 105 and being positioned within a wellbore in a subterranean formation 112 for hydrocarbon resource recovery. The RF antenna assembly 107 illustratively includes first and second tubular conductors 116*a*-116*b*, a dielectric isolator 115 coupled between the first and second tubular conductors, an RF transmission line 139 comprising an inner conductor 140 and an outer conductor 141 extending within the first tubular conductor, the outer conductor being coupled to the first tubular conductor, and a feed structure 122 coupled to the second tubular conductor. The inner conductor 140 includes a distal end 117 being slidable within the outer conductor 141 and cooperating with the feed structure 122 to define a latching arrangement having a latching threshold lower than an unlatching threshold.

Another aspect is directed to a method for assembling a hydrocarbon resource recovery system 105. The method includes positioning first and second tubular conductors 116*a*-116*b* in a wellbore with a dielectric isolator 115 coupled between the first and second tubular conductors, and positioning an outer conductor 141 of an RF transmission line 139 in the wellbore, the outer conductor extending within the first tubular conductor and being coupled to the first tubular conductor. The method comprises positioning a feed structure 122 coupled to the second tubular conductor 116*b*, and positioning an inner conductor 140 of the RF transmission line 139 in the wellbore, the inner conductor having a distal end 117 being slidable within the outer conductor 141 and cooperating with the feed structure to define a latching arrangement having a latching threshold lower than an unlatching threshold. The method includes latching the distal end 117 of the inner conductor 140 to the feed structure 122 to define the RF antenna assembly 107 coupled to an RF source.

Another aspect is directed to a method for hydrocarbon resource recovery from a subterranean formation 112. The method includes positioning first and second tubular conductors 116*a*-116*b* in a wellbore 113 in the subterranean formation 112 with a dielectric isolator 115 coupled between the first and second tubular conductors, and positioning an outer conductor 141 of an RF transmission line 139 within the first tubular conductor and being coupled to the first tubular conductor. The method includes positioning an inner conductor 140 of the RF transmission line 139 within the outer conductor 141 and cooperating with a feed structure 122 coupled to the second tubular conductor 116*b* to define a latching arrangement having a latching threshold lower than an unlatching threshold. In some embodiments, the method may include supplying RF power to the RF transmission line 139.

Another aspect is directed to a method for assembling a hydrocarbon resource recovery system 105. The method includes coupling an RF antenna assembly 107 to an RF source 106 and within a wellbore in a subterranean formation 112 for hydrocarbon resource recovery. The RF antenna assembly 107 includes first and second tubular conductors 116*a*-116*b*, a dielectric isolator 115 coupled between the first and second tubular conductors, an RF transmission line 139 comprising an inner conductor 140 and an outer conductor 141 extending within the first tubular conductor, the outer conductor being coupled to the first tubular conductor, and a feed structure 122 coupled to the second tubular conductor. The inner conductor 140 has a distal end 117 being slidable within the outer conductor 141 and cooperating with the feed structure 122 to define a latching arrangement having a latching threshold lower than an unlatching threshold.

Referring now to FIGS. 25-28, a method for hydrocarbon resource recovery and a hydrocarbon resource recovery system 144 are now described with reference to a flowchart 165. The hydrocarbon resource recovery system 144 illustratively includes an RF antenna assembly 147 within a first wellbore 148 in a subterranean formation 146 for hydrocarbon resource recovery. The RF antenna assembly 147 illustratively includes first and second tubular conductors 151-152, a dielectric isolator 154 between the first and second tubular conductors so that the first and second tubular conductors define a dipole antenna, and a dielectric coating (e.g. PTFE) 159 surrounding the dielectric isolator, and extending along a predetermined portion of the first and second tubular conductors, for example, defining a start-up antenna length.

The RF antenna assembly 147 illustratively includes an RF transmission line 155 comprising an inner conductor and an outer conductor extending within the first tubular conductor. The hydrocarbon resource recovery system 144 also includes an RF source 145 coupled to the RF transmission line 155 and configured to during a start-up phase, operate at a first power level to desiccate water adjacent the RF antenna assembly 147, and during a sustainment phase, operate at a second power level less than or equal to the first power level to recover hydrocarbons from the subterranean formation 146.

The hydrocarbon resource recovery system 144 also includes a producer well 150 within a second wellbore 149, and includes a pump 158 configured to move produced hydrocarbons to the surface of the subterranean formation 146. The dielectric coating 159 may be 1 m up to the full length of the antenna.

The RF antenna assembly 147 illustratively includes a dielectric coupler 153 between the first and second electrical contact sleeves 161, 162, a distal guide string 156 coupled to the second electrical contact sleeve, and an RF transmission line 155 comprising an inner conductor (e.g. one or more of Beryllium copper, copper, aluminum) and an outer conductor (e.g. one or more of Beryllium copper, copper, aluminum) extending within the first tubular conductor 151. The RF antenna assembly 147 illustratively includes a dielectric heel isolator 157 coupled to first tubular conductor 151.

Figure 27:
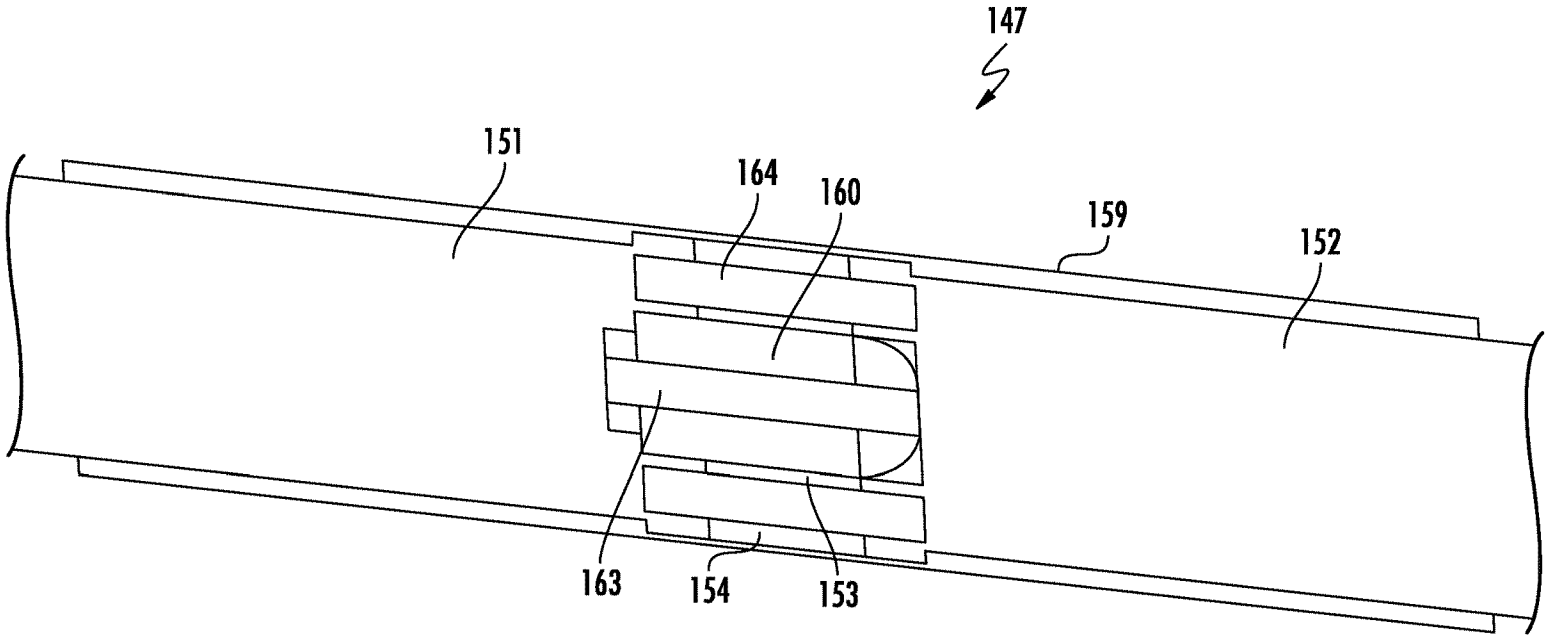
FIG. 27 is a cross-sectional view of a portion of the RF antenna assembly from the hydrocarbon resource recovery system of FIG. 25.

Referring now particularly to FIG. 27, the RF antenna assembly 147 illustratively includes an inner conductor 163 extending within the dielectric coupler 153 and the dielectric isolator 154, and a dielectric purging fluid 160 between the inner conductor and the dielectric coupler. The dielectric purging fluid 160 may comprise, for example, mineral oil (such as Alpha fluid, as available from DSI Ventures, Inc. of Tyler, Tex.). The RF antenna assembly 147 illustratively includes a feed annulus 164 between the dielectric coupler 153 and the dielectric isolator 154.

Figure 28:
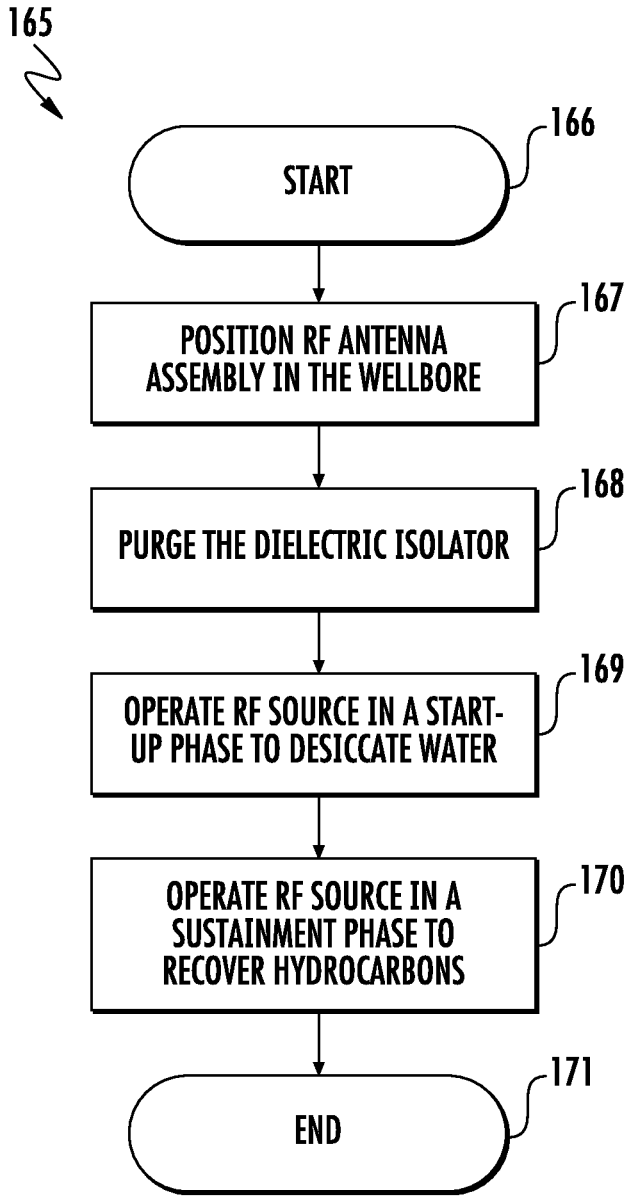
FIG. 28 is a flowchart for operating the hydrocarbon resource recovery system of FIG. 25.
Figure 29:
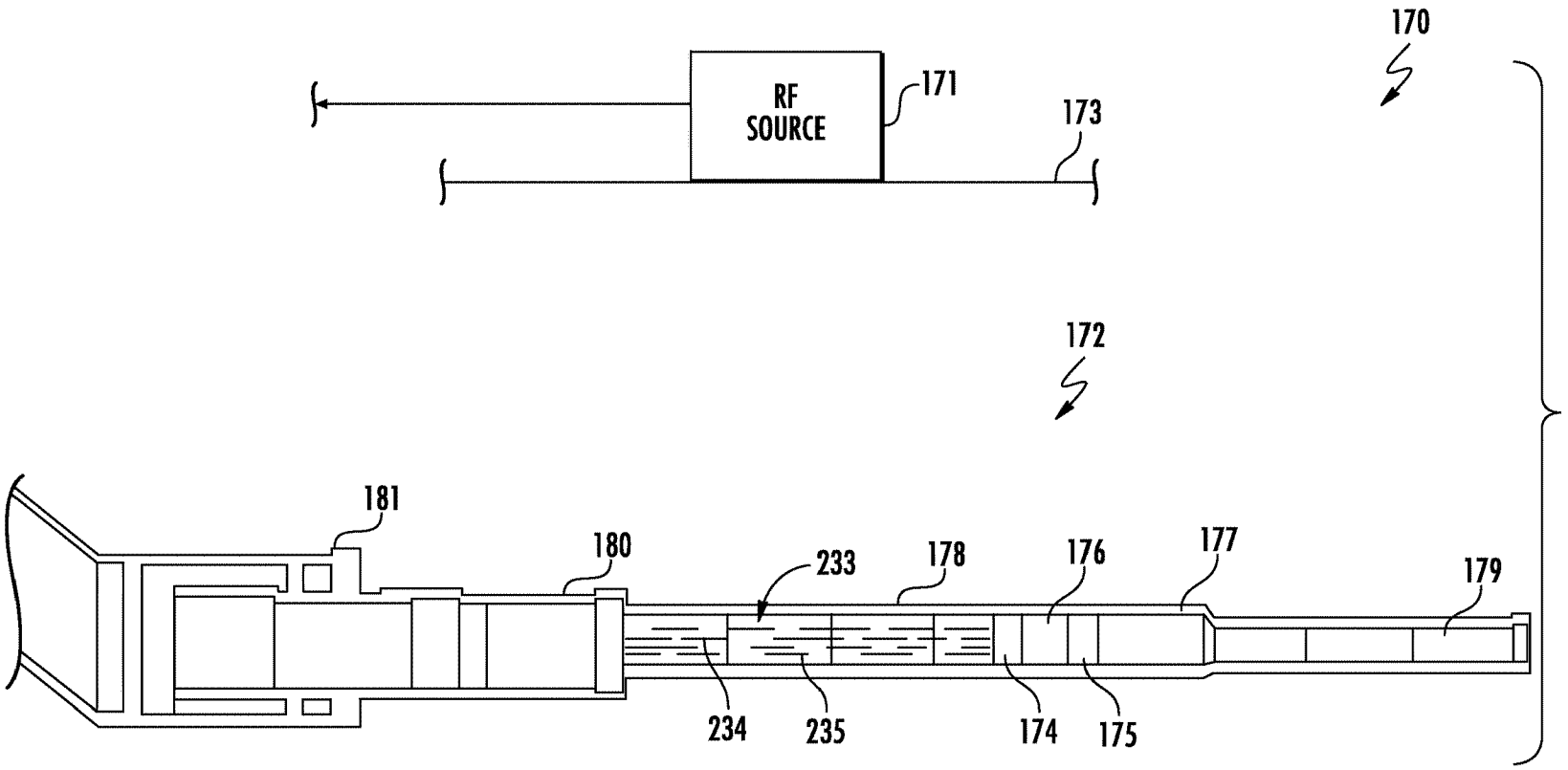
FIG. 29 is a schematic diagram of another embodiment of the hydrocarbon resource recovery system, according to the present disclosure.
Figure 30:
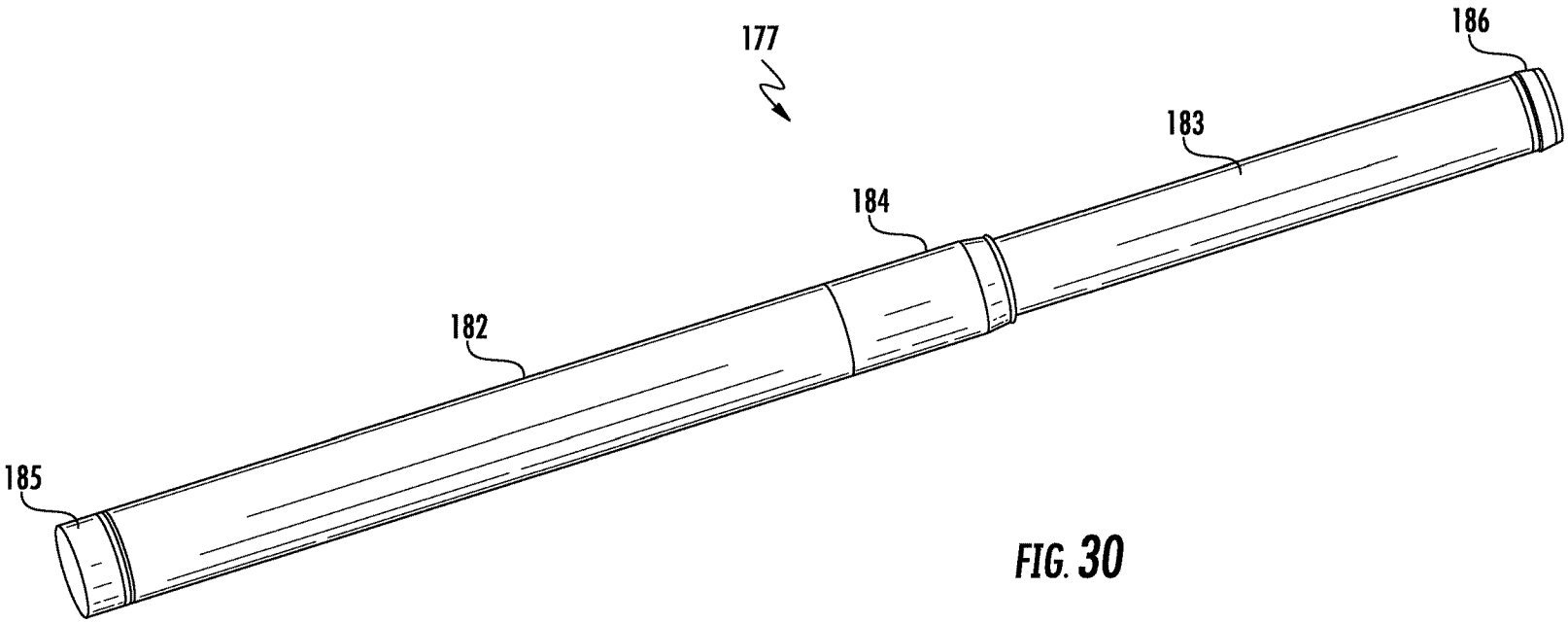
FIG. 30 is a perspective view of a thermal expansion accommodation device from the hydrocarbon resource recovery system of FIG. 29.
Figure 31:
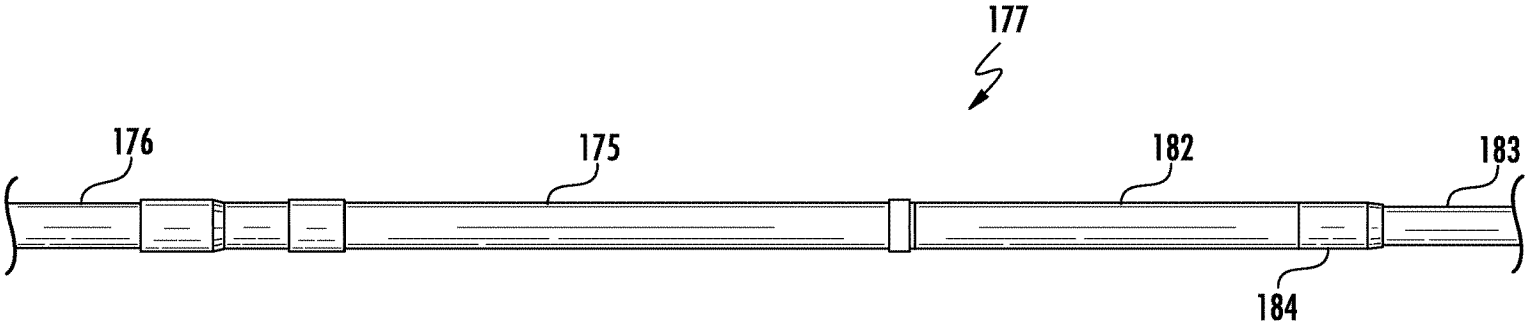
FIGS. 31 and 32 are side elevational and cross-section views, respectively, of the thermal expansion accommodation device and an adjacent electrical contact sleeve from the hydrocarbon resource recovery system of FIG. 29.
Figure 32:
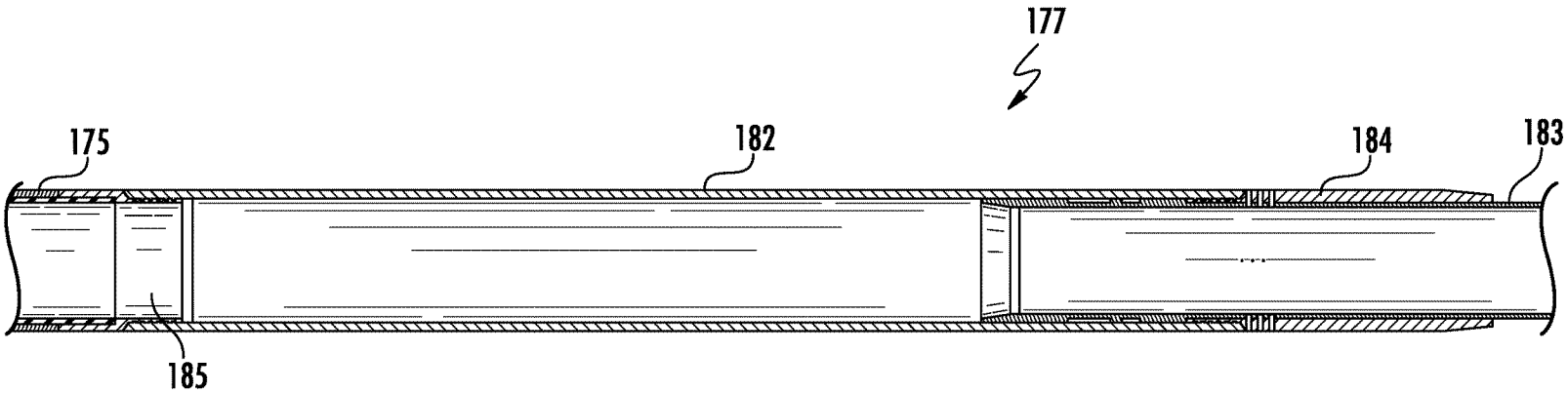
Figure 33:
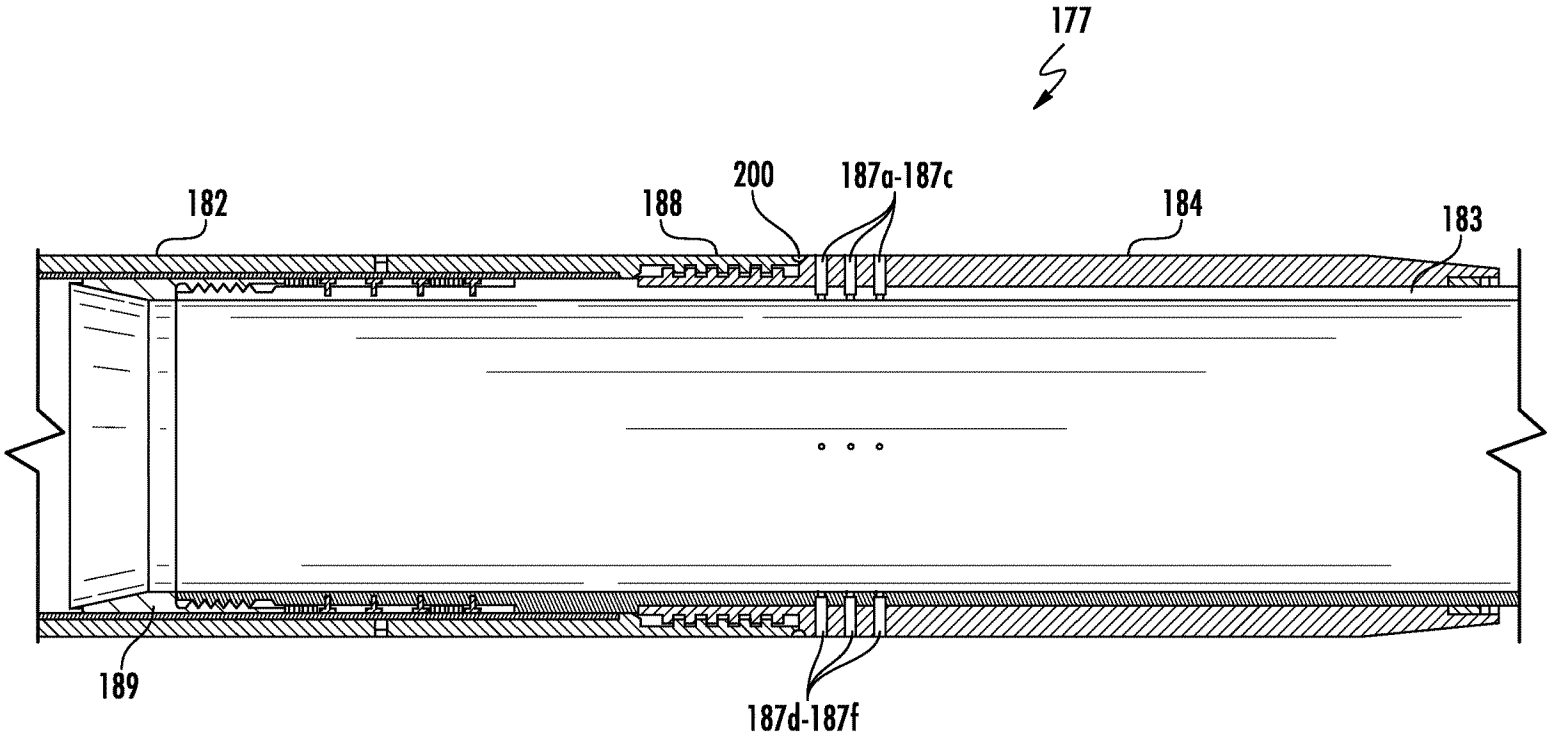
FIGS. 33-34 are cross-sectional views of portions of the thermal expansion accommodation device from the hydrocarbon resource recovery system of FIG. 29.
Figure 34:
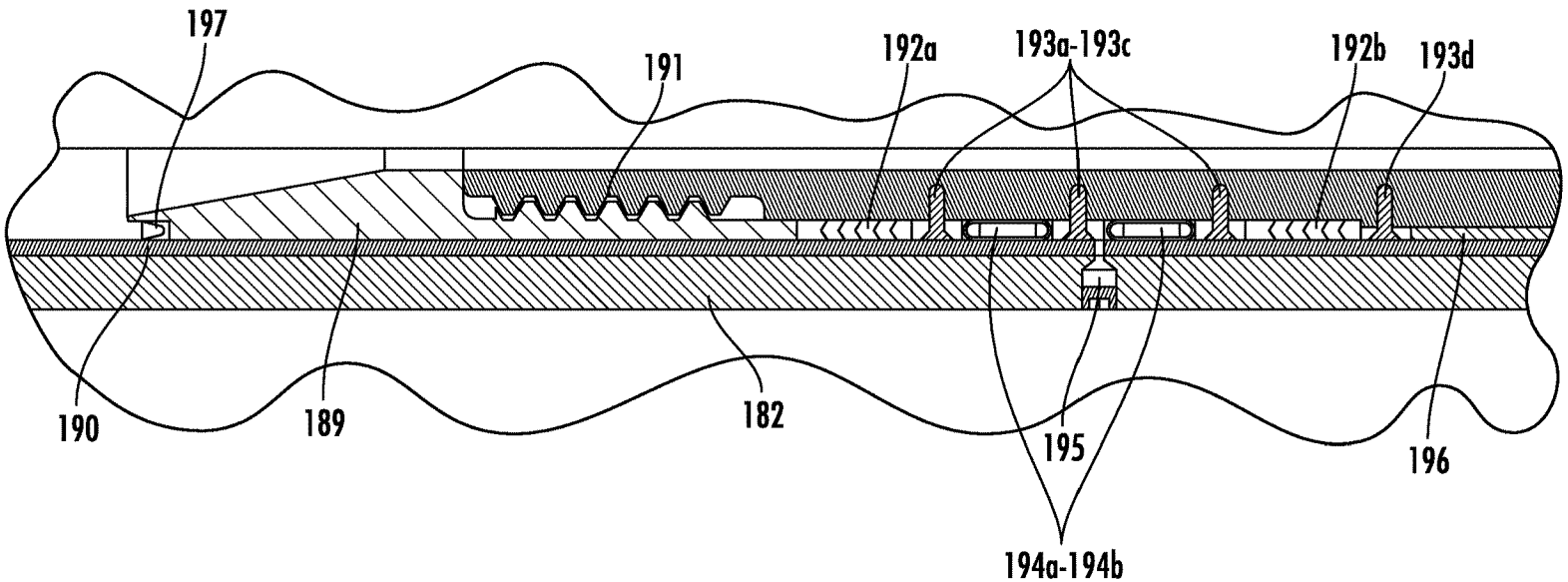
Figure 35:
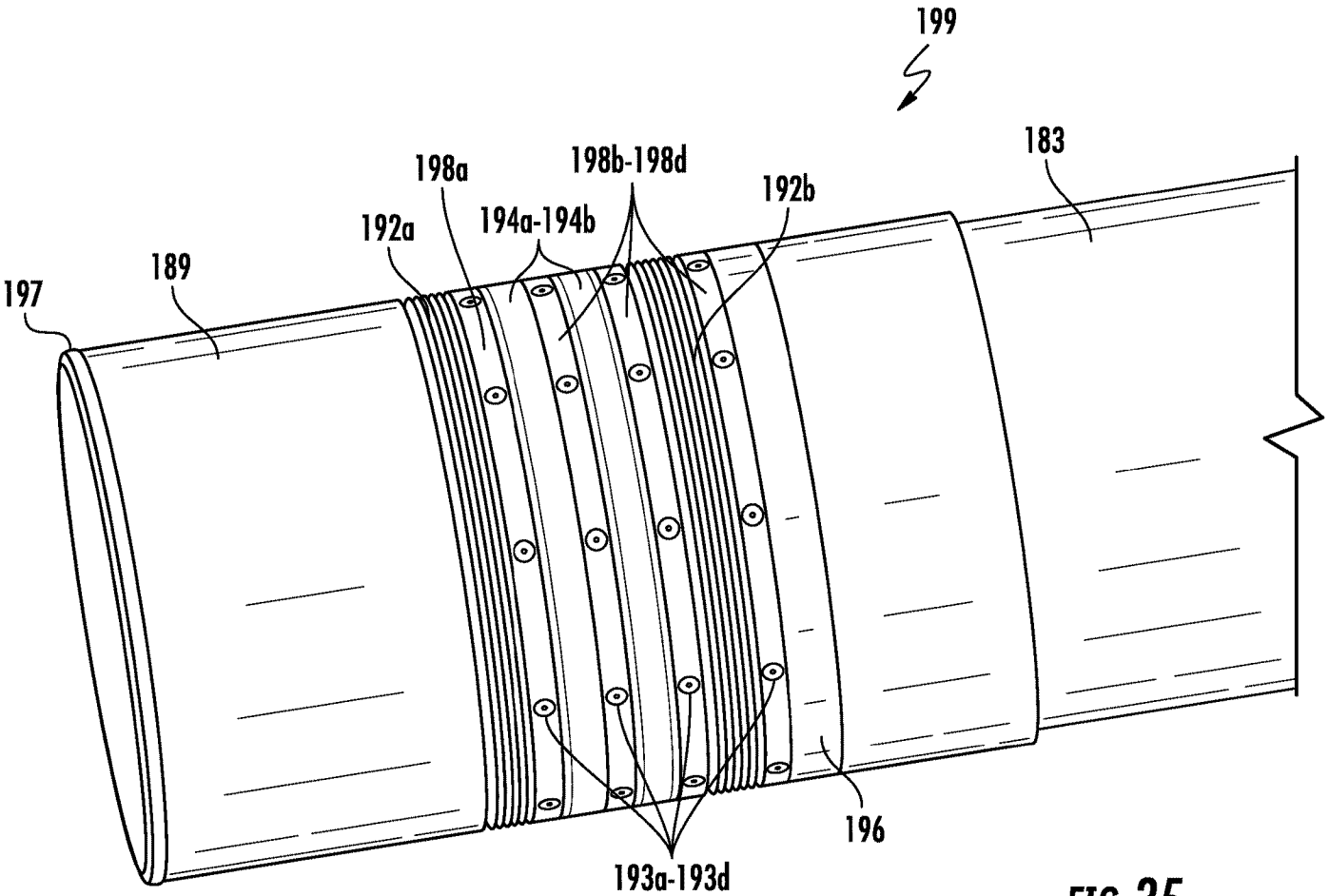
FIG. 35 is a perspective view of an end of a tubular sleeve from the thermal expansion accommodation device from the hydrocarbon resource recovery system of FIG. 29.

Referring now particularly to FIG. 28, the method of hydrocarbon resource recovery using the hydrocarbon resource recovery system 144 is now described. The method illustratively includes positioning an RF antenna assembly 147 within a first wellbore 148 in a subterranean formation 146. (Blocks 166-167). The RF antenna assembly 147 includes first and second tubular conductors 151, 152 and a dielectric isolator 154 therebetween defining a dipole antenna, and a dielectric coating 159 surrounding the dielectric isolator and extending along a predetermined portion of the first and second tubular conductors defining a start-up antenna length. The method includes operating an RF source 145 coupled to the RF antenna assembly 147 during a start-up phase to desiccate water adjacent the RF antenna assembly, and operating the RF source coupled to the RF antenna assembly during a sustainment phase to recover hydrocarbons from the subterranean formation 146. (Blocks 169-171).

In some embodiments, the operating of the RF source 145 during the start-up phase comprises operating the RF source at a first power level, and the operating of the RF source during the sustainment phase comprises operating the RF source at a second power level less than or equal to the first power level. Also, the positioning of the RF antenna assembly 147 within the first wellbore 148 in the subterranean formation 146 comprises positioning the RF antenna assembly in an injector well. The method also includes recovering the hydrocarbon from a producer well 150 in the subterranean formation 146 adjacent the injector well. Moreover, the method illustratively includes purging an interior of the dielectric isolator 154 with a fluid 160 during at least one of the start-up phase and the sustainment phase. (Block 168).

In some embodiments, the fluid 160 may enter the interior of the dielectric isolator 154 through a fluid passageway defined by an inner conductor 163 of an RF transmission line 155 coupled to the RF antenna assembly 147. The fluid 160 may exit the interior of the dielectric isolator 154 through first and second electrical contact sleeves 161, 162 respectively coupled between the first and second tubular conductors 151, 152 and the dielectric isolator. The method further comprises operating the RF source 145 at a frequency between 10 kHz and 10 MHz. The dielectric coating 159 may comprise PTFE material, for example. For instance, the dielectric coating 159 may be between 1 m to full length of antenna with preferred embodiment being 10 m.

Another aspect is directed to a method for hydrocarbon resource recovery with an RF antenna assembly 147 within a first wellbore 148 in a subterranean formation 146. The RF antenna assembly 147 includes first and second tubular conductors 151, 152, a dielectric isolator 154 defining a dipole antenna, first and second electrical contact sleeves 161, 162 respectively coupled between the first and second tubular conductors and the dielectric isolator, and a dielectric coating 159 surrounding the dielectric isolator, the first and second electrical contact sleeves, and extending along a predetermined portion of the first and second tubular conductors defining a start-up antenna length. The method includes operating an RF source 145 coupled to the RF antenna assembly 147 during a start-up phase at a first power level and to desiccate water adjacent the RF antenna assembly, and operating the RF source coupled to the RF antenna assembly at a second power level less than or equal to the first power level during a sustainment phase to recover hydrocarbons from the subterranean formation 146.

In some embodiments, the first and second tubular conductors 151, 152, the dielectric isolator 153, the first and second electrical contact sleeves 161, 162 are all part of the well casing. Since the first wellbore 148 can be a damp environment with high conductivity water present, in typical approaches, the impedance of the dipole antenna would be very low, approaching a short circuit with increasing water conductivity. In particular, the bare antenna increases the Voltage Standing Wave Ratio (VSWR), drastically increasing the difficulty (and expense) of the required impedance matching network of the transmitter. For example, the expense of a matching network that could match a 5:1 VSWR load for any phase of reflection coefficient is higher than one designed for a 2:1 VSWR load. This is due not only to the required higher values and tuning ranges of the inductors and capacitors, but the resulting higher currents and voltage stresses that these components would need to tolerate as well. If the VSWR were too high, this would potentially prevent the transmitter from delivering sufficient power to the formation.

Accordingly, in typical approaches, the RF source 145 would comprise multiple RF transmitters, such as a first initial high VSWR start-up RF transmitter and a second sustaining transmitter having a lower VSWR requirement. The start-up phase can be quite long, for example, up to six months. The first transmitter would enable desiccation of the adjacent portions of the first wellbore 148, and the second transmitter (e.g. lower VSWR sustainment) would be subsequently coupled to the RE transmission line 155. The sustainment phase could last 6-15 years, but due to the costly nature of the start-up transmitter, the operational power costs are about the same, ~$10-12 million. In a typical hydrocarbon resource recovery operation, efficiency is important. This is due to the costly nature of powering RF transmitters in hydrocarbon resource recovery.

Advantageously, in the disclosed embodiments, the RF antenna assembly 147 has the dielectric coating 159 on the first and second electrical contact sleeves 161, 162 and at least a portion of the first and second tubular conductors 151, 152. In other words, the dipole antenna has a minimum starting antenna length, and a single RF transmitter can be used, i.e. the first RF transmitter can be eliminated, saving more than $10 million. Since the first RF transmitter is not needed, capital expenditures are reduced. Moreover, these RF transmitters are large and ungainly, making them expensive to swap out. The dielectric coating 159 helpfully provides for impedance control for the dipole antenna, and improves electrical breakdown across the surface of the dielectric isolator 154.

The dielectric coating 159 may be formed on the dielectric isolator 154 and the first and second tubular conductors 151, 152 via one or more of the following: composite wrap on the exterior, spraying on the dielectric coating, or via a thermal shrink fit of the dielectric material.

Other features relating to the dielectric coating 159 and the manufacture thereof are found in U.S. patent application Ser. No. 15/426,168 filed Feb. 7, 2017, assigned to the present applications assignee, which is incorporated herein by reference in its entirety.

Other features relating to hydrocarbon resource recovery are disclosed in U.S. Pat. No. 9,376,897 to Ayers et al., which is incorporated herein by reference in its entirety.

Referring now to FIGS. 29-36, yet another embodiment of a hydrocarbon resource recovery system 170. This hydrocarbon resource recovery system 170 illustratively includes an RF source 171, and an RF antenna assembly 172 coupled to the RF source and within a wellbore 181 in a subterranean formation 173 for hydrocarbon resource recovery.

The RF antenna assembly 172 illustratively includes first and second tubular conductors 178, 179, a dielectric isolator 176, and first and second electrical contact sleeves 174, 175 respectively coupled between the first and second tubular conductors and the dielectric isolator so that the first and second tubular conductors define a dipole antenna. The RF antenna assembly 172 illustratively includes a heel dielectric isolator 180 coupled to the first tubular conductor 178.

The RF antenna assembly 172 illustratively includes a thermal expansion accommodation device 177 configured to provide a sliding arrangement between the second tubular conductor 179 and the second electrical contact sleeve 175 when a compressive force therebetween exceeds a threshold. In the illustrated embodiment, the thermal expansion accommodation device 172 illustratively includes a first tubular sleeve 182 coupled to the second electrical contact sleeve 175, and a second tubular sleeve 183 coupled to the second tubular conductor 179 and arranged in telescopic relation with the first tubular sleeve. The first and second tubular sleeves 182, 183 may each comprise stainless steel, for example. In the illustrated embodiment, the diameter of the first tubular sleeve 182 is greater than that of the second tubular sleeve 183, but in other embodiments, this may be reversed (i.e. the diameter of the first tubular sleeve 182 is less than that of the second tubular sleeve 183).

The thermal expansion accommodation device 177 illustratively includes a first tubular sleeve extension 184 coupled to the first tubular sleeve 182 via a threaded interface 188, and a plurality of shear pins 187*a*-187*f* extending transversely through the first and second tubular sleeves 182, 183, and the first tubular sleeve extension 183. When the compressive force therebetween exceeds the threshold, the plurality of shear pins 187*a*-187*f* will break and permit telescoping action of the second tubular sleeve 183 within along an internal surface 190 of the first tubular sleeve 182.

The thermal expansion accommodation device 172 illustratively includes a proximal end cap 185 coupled between the first tubular sleeve 182 and the second electrical contact sleeve 175. The second tubular sleeve 183 also illustratively includes a threaded interface 186 on a distal end to be coupled to the second tubular conductor 179.

The thermal expansion accommodation device 177 illustratively includes a plurality of watchband springs 194*a*-194*b* electrically coupling the first and second tubular sleeves 182, 183. The second tubular sleeve 183 illustratively has a threaded surface 188 on an end thereof. The thermal expansion accommodation device 177 illustratively includes an end cap 189 having an inner threaded surface 191 (FIG. 34) coupled to the threaded surface 191 of the second tubular sleeve 183, and a wiper seal 197 carried on an annular edge of the end cap 189.

The thermal expansion accommodation device 177 illustratively includes a plurality of seals 192*a*-192*b* between the first and second tubular sleeves 182, 183, and a lubricant injection port 195 configured to provide access to areas adjacent the plurality of seals. The thermal expansion accommodation device 177 illustratively includes a plurality of fasteners 193*a*-193*c* extending through the end cap 189 and the second tubular sleeve 183.

Also, the RF antenna assembly 172 illustratively includes an RF transmission line 233 comprising an inner conductor 234 and an outer conductor 235 extending within the first tubular conductor 178. The dielectric isolator 176 may include a tubular dielectric member and a PTFE coating (e.g. as noted in the hereinabove disclosed embodiments) thereon.

Figure 36:
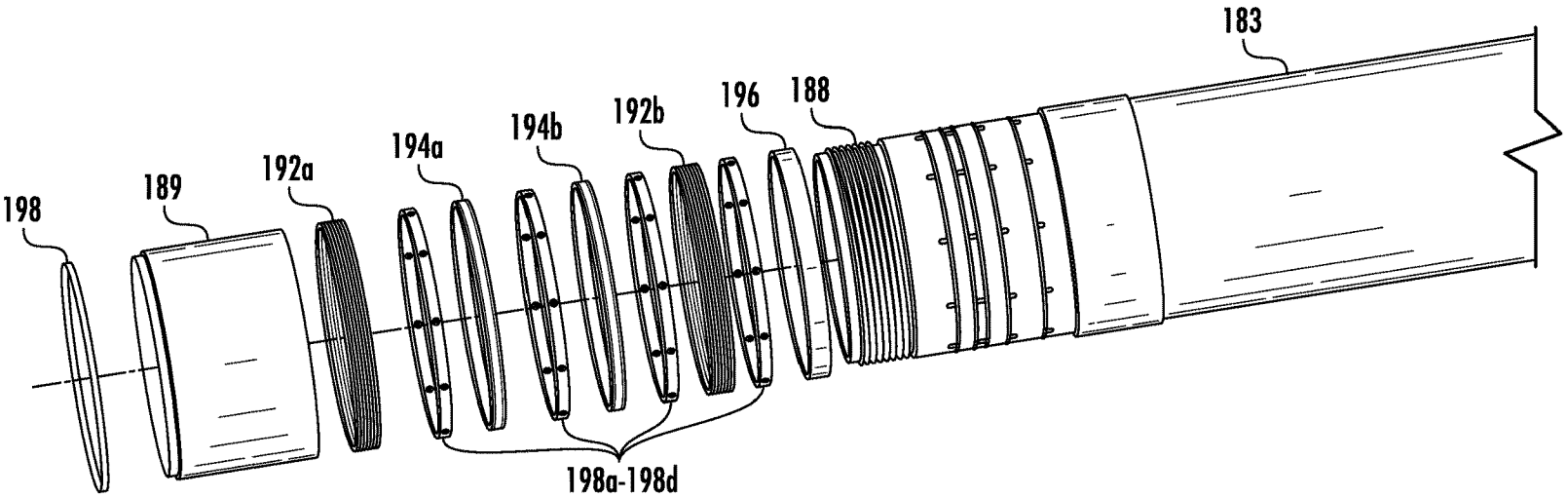
FIG. 36 is an exploded view of the end of the tubular sleeve from the thermal expansion accommodation device from the hydrocarbon resource recovery system of FIG. 29.
Figure 37:
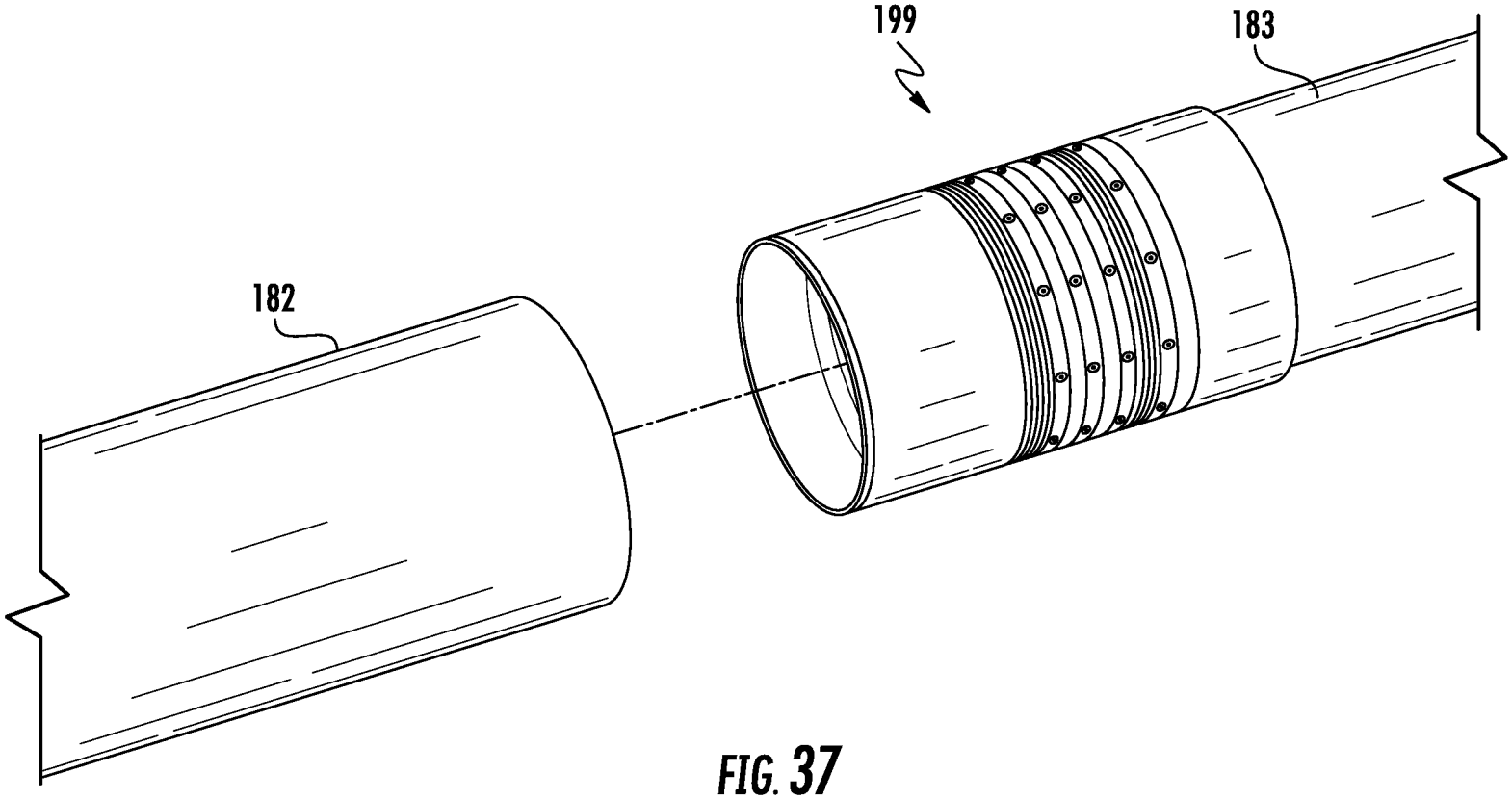
FIGS. 37-39 are perspective views of opposing ends of first and second tubular sleeves from the thermal expansion accommodation device from the hydrocarbon resource recovery system of FIG. 29 during assembly.

As perhaps best seen in FIGS. 36-37, the proximal end of the second tubular sleeve 183 is shown without the first tubular sleeve 182 installed thereon. The proximal end of the second tubular sleeve 183 illustratively includes a threaded interface 188 configured to engage the threaded interface 191 of the end cap 189. The thermal expansion accommodation device 177 illustratively includes a wear ring 196 coupled to the proximal end of the second tubular sleeve 183, and a plurality of spacers 198*a*-198*d* interspersed between the plurality of seals 192*a*-192*b* and the plurality of watchband springs 194*a*-194*b*.

Another aspect is directed to an RF antenna assembly 172 coupled to a RF source 171 and being within a wellbore 181 in a subterranean formation 173 for hydrocarbon resource recovery. The RF antenna assembly 172 includes first and second tubular conductors 178, 179, a dielectric isolator 176, and first and second electrical contact sleeves 174, 175 respectively coupled between the first and second tubular conductors and the dielectric isolator so that the first and second tubular conductors define a dipole antenna. The RF antenna assembly 172 comprises a thermal expansion accommodation device 177 configured to provide a sliding arrangement between the second tubular conductor 179 and the second electrical contact sleeve 175 when a compressive force therebetween exceeds a threshold.

Another aspect is directed to a method of hydrocarbon resource recovery. The method includes positioning an RF antenna assembly 172 within a wellbore 181 in a subterranean formation 173. The RF antenna assembly 172 includes first and second tubular conductors 178, 179, a dielectric isolator 176, first and second electrical contact sleeves 174, 175 respectively coupled between the first and second tubular conductors and the dielectric isolator so that the first and second tubular conductors define a dipole antenna, and a thermal expansion accommodation device 177 configured to provide a sliding arrangement between the second tubular conductor and the second electrical contact sleeve when a compressive force therebetween exceeds a threshold.

Figure 38:
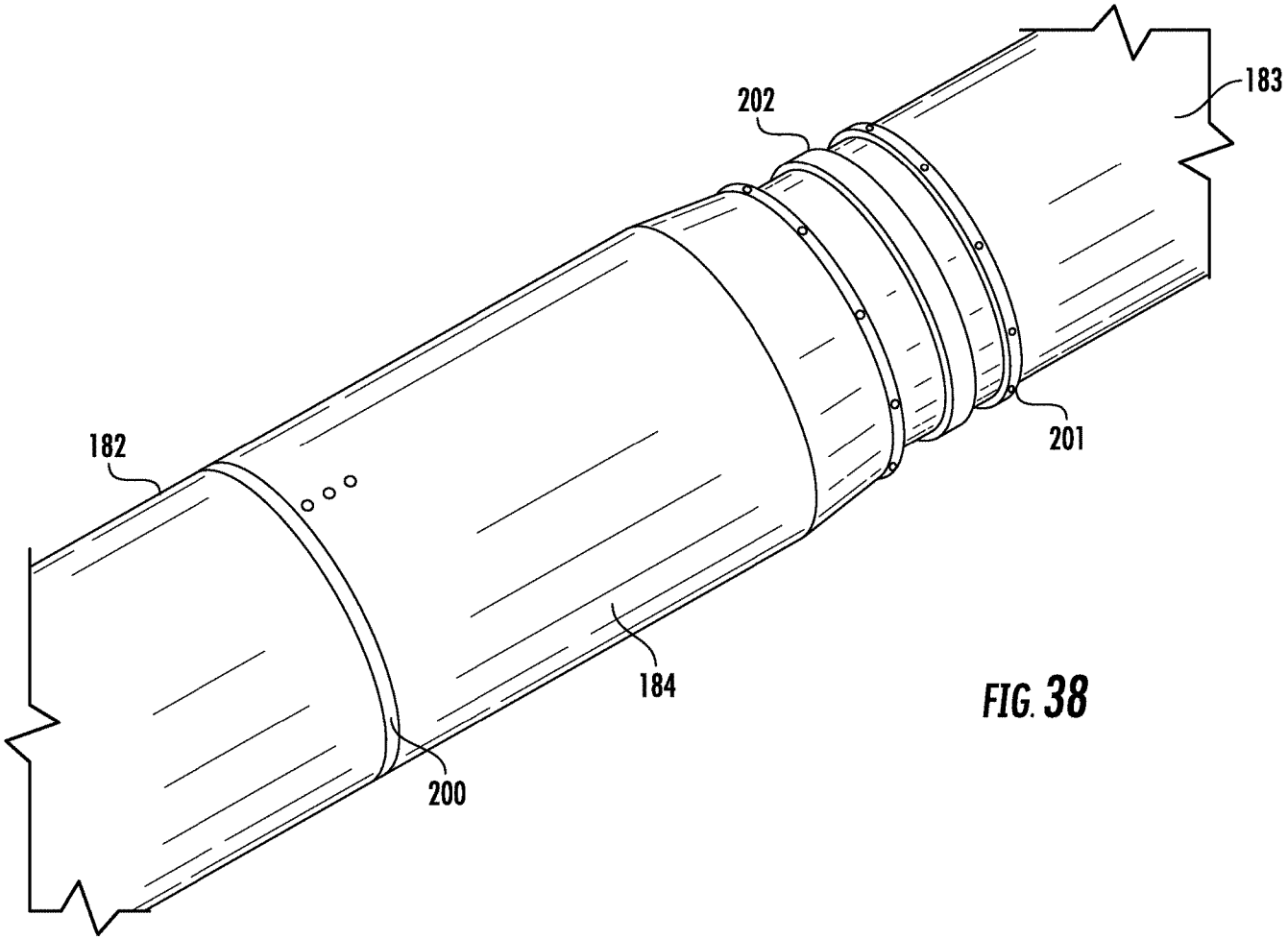
Figure 39:
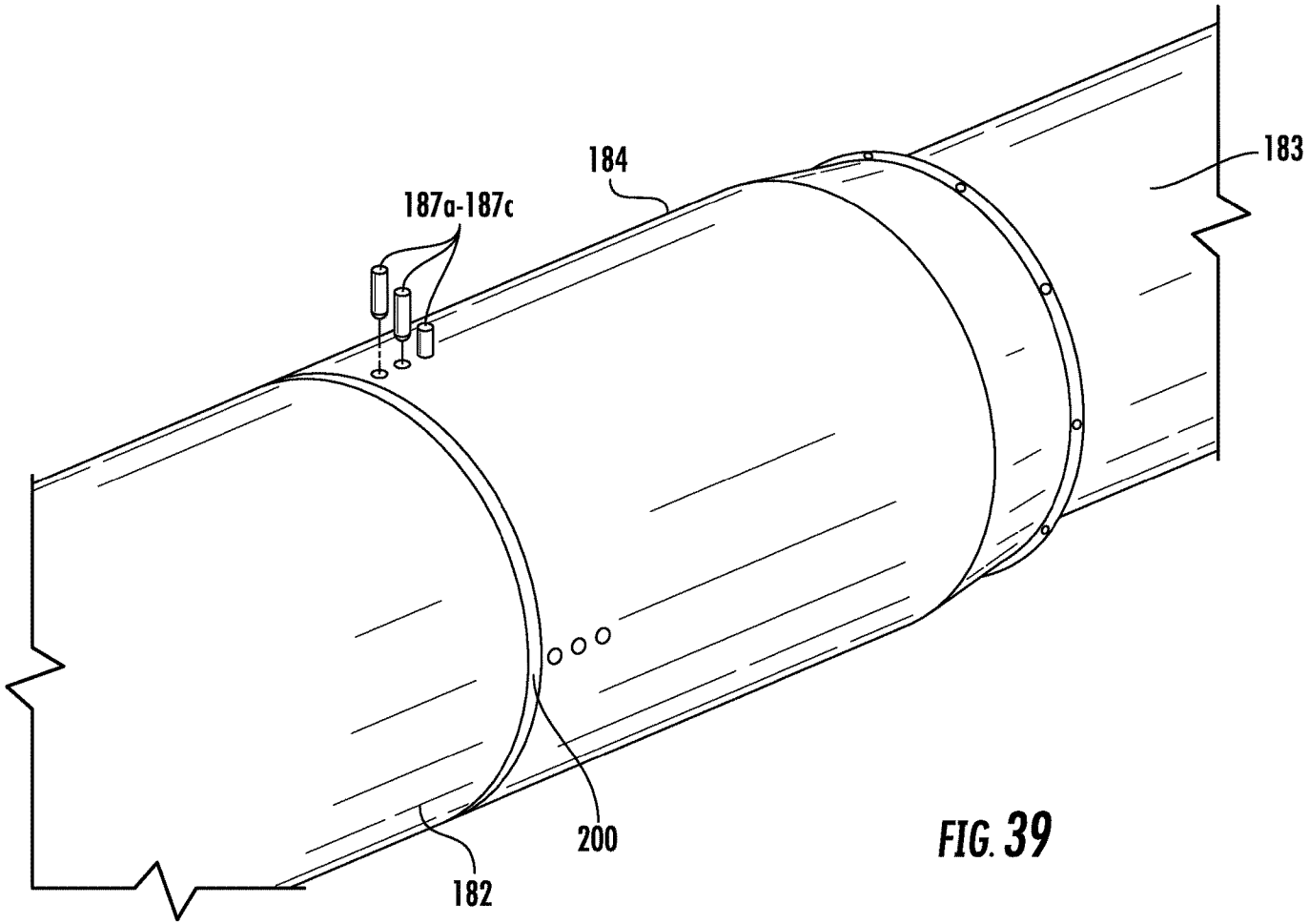
Figure 40:
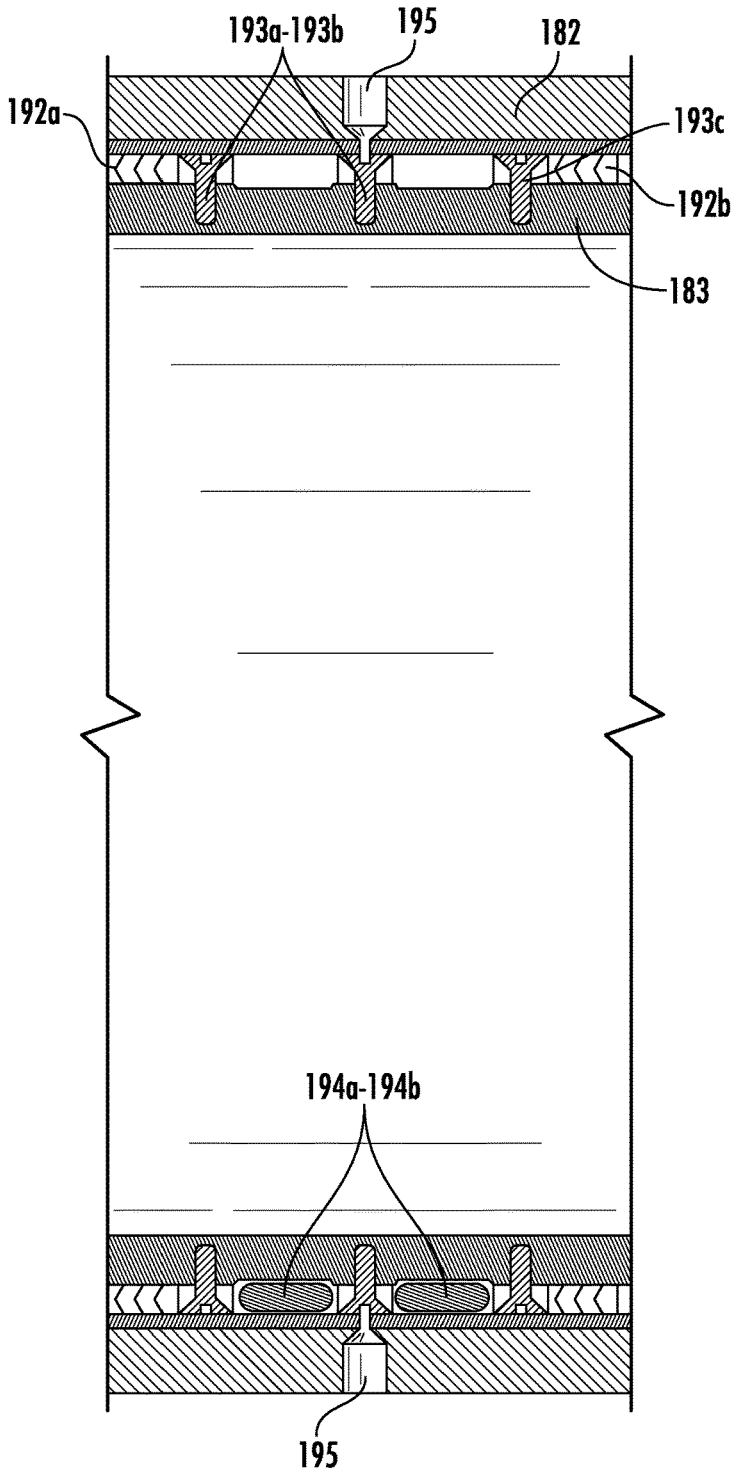
FIG. 40 is a cross-sectional view of a portion of the thermal expansion accommodation device from the hydrocarbon resource recovery system of FIG. 29.

Referring now additionally to FIGS. 37-40, the steps for assembling the thermal expansion accommodation device 177 are now described. In FIG. 37, the assembled proximal end 199 of the second tubular sleeve 183 is inserted into the first tubular sleeve 182. In FIG. 38, an outer wear band 202 and a retainer band 201 are fitted over the second tubular sleeve 183. The first tubular sleeve 182 and the first tubular sleeve extension 184 are threaded together and an annular weld 200 is formed. Thereafter, the second tubular sleeve 183 is against the mechanical stop formed by the proximal end of the first tubular sleeve extension 184, thereby matching drilled holes for the plurality of shear pins 187*a*-187*f*. The plurality of shear pins 187*a*-187*f* is then press fitted into the drilled holes, and a lubricant is dispensed through the injection port 195.

In the illustrated embodiments, the thermal expansion accommodation device 177 uses threaded interfaces for coupling components together. Of course, in other embodiments, the threaded interfaces can be replaced with fastener based couplings or weld based couplings. Also, in another embodiment, the first tubular sleeve 182 may include an outer sleeve configured to provide a corrosion shield. Also, in another embodiment, the first tubular sleeve 182 may be elongated to protect the inside wall from both internal and external environment.

Advantageously, the thermal expansion accommodation device 177 provides an approach to thermal expansion issues within the RF antenna assembly 172. In typical approaches, one common point of failure when the first and second tubular conductors 178, 179 experience thermal expansion is the dielectric isolator 176 and the heel dielectric isolator 180. In the hydrocarbon resource recovery system 170 disclosed herein, instead of the dielectric isolator 176 or the heel dielectric isolator 180 buckling under compressive pressure, the plurality of shear pins 187*a*-187*f* will break and permit telescoping action of the second tubular sleeve 183 within along an internal surface 190 of the first tubular sleeve 182. Indeed, during typical operation, the plurality of shear pins 187*a*-187*f* will shear, and when the RF antenna assembly 172 is removed from the wellbore 181, the mechanical stop formed by the proximal end of the first tubular sleeve extension 184 will enable the thermal expansion accommodation device 177 to be removed.

Moreover, the thermal expansion accommodation device 177 is flexible in that the threshold for the compressive force is settable via the plurality of shear pins 187*a*-187*f*. Also, the thermal expansion accommodation device 177 provides a solid electrical connection during the thermal growth of the first and second tubular sleeves 182, 183, which provides corrosion resistance and reservoir fluid isolation.

Referring now to FIGS. 41-45, another embodiment of a hydrocarbon resource recovery system 203 is now described. The hydrocarbon resource recovery system 203 illustratively includes an RF source 204, a producer well pad 240, an injector well pad 241, and a plurality of RF antenna assemblies 206*a*-206*c* coupled to the RF source and extending laterally within respective laterally spaced first wellbores 236 in a subterranean formation 208 for hydrocarbon resource recovery. Each RF antenna assembly 206*a*-206*c* illustratively includes first and second tubular conductors 213, 215, and a dielectric isolator 214 coupled between the first and second tubular conductors to define a dipole antenna.

The hydrocarbon resource recovery system 203 illustratively includes a plurality of solvent injectors 205*a*-205*c* within respective laterally extending wellbores extending transverse (i.e. between 65-115 degrees of canting) and above the RF antenna assemblies 206*a*-206*c* and configured to selectively inject solvent into the subterranean formation 208 adjacent the RF antenna assemblies. Also, the hydrocarbon resource recovery system 203 illustratively includes a plurality of producer wells 207*a*-207*c* extending laterally in respective second wellbores 237 in the subterranean formation 208 for hydrocarbon resource recovery and being below the RF antenna assemblies 206*a*-206*c*, and a pump 216 within each producer well and configured to move produced hydrocarbons to a surface of the subterranean formation 208. Although in the illustrated embodiment, there are a plurality of RF antenna assemblies 206*a*-206*c* and a corresponding plurality of producer wells 207*a*-207*c*, in other embodiments, there may be more or fewer well pairs within the subterranean formation 208.

In the illustrated embodiment, the plurality of RF antenna assemblies 206*a*-206*c* and the plurality of producer wells 207*a*-207*c* extend from the producer well pad 240. Also, the plurality of solvent injectors 205*a*-205*c* extends from the injector well pad 241.

Figure 41:
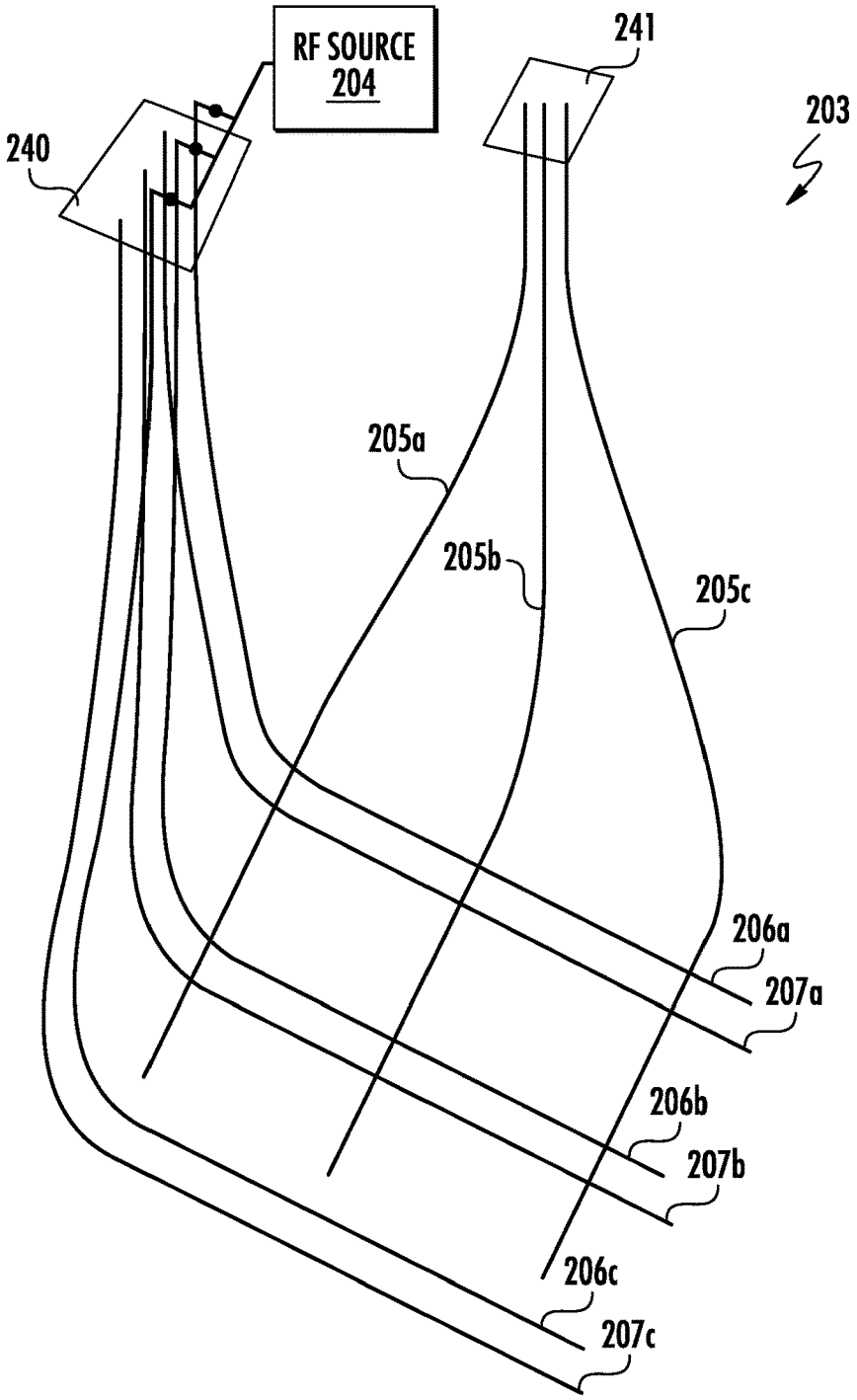
FIG. 41 is a schematic diagram of another embodiment of the hydrocarbon resource recovery system, according to the present disclosure.
Figure 42:
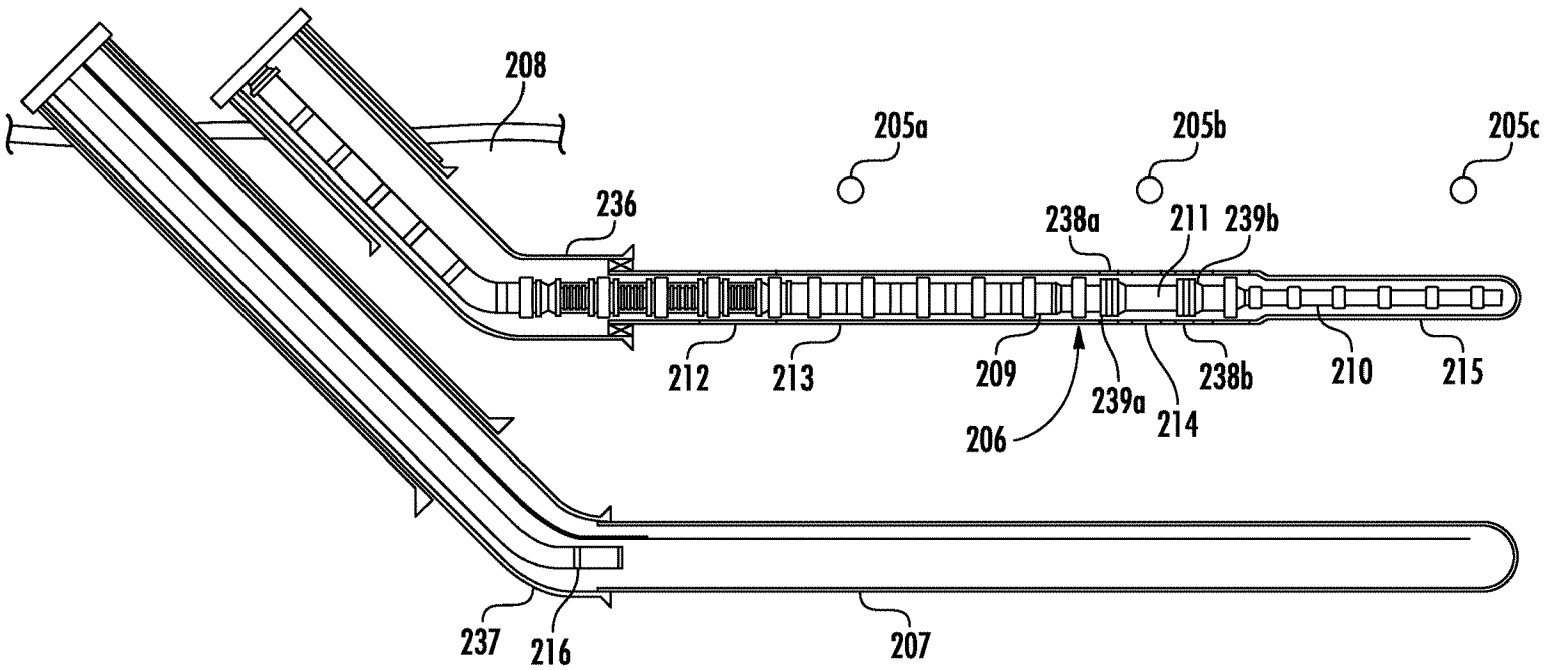
FIG. 42 is another schematic diagram of the hydrocarbon resource recovery system of FIG. 41.
Figure 43:
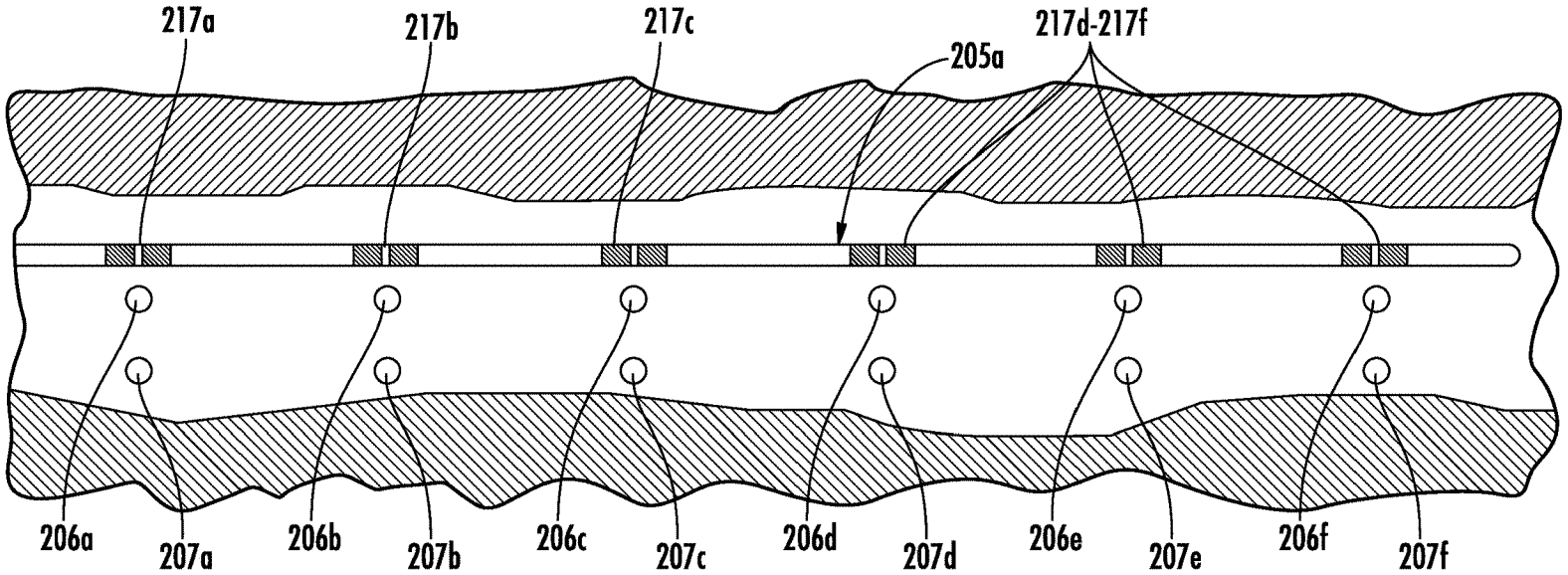
FIG. 43 is a schematic diagram of a solvent injector in the hydrocarbon resource recovery system of FIG. 41.

In the illustrated embodiment, each solvent injector 205*a*-205*c* includes a plurality of flow regulators (e.g. injection valves, chokes, multi-position valves that may include chokes, or other flow controlling devices) 217*a*-2172 respectively aligned with respective ones of the plurality of RF antenna assemblies 206*a*-206*c*. It is noted that for enhanced clarity of explanation, only three well pairs are depicted in FIG. 41 rather than the six well pairs 206*a*-206*f*, 207*a*-207*f* depicted in FIG. 43. Each flow regulator 217*a*-217*f* may have a selective flow rate, permitting flexible solvent injection. The selective flow of each flow regulator 217*a*-217*f* may be enabled via hydraulic control, electric control, a combination of electric and hydraulic control, or via a coil tube shifting feature, for example. In some embodiments, each flow regulator 217*a*-217*f* may have three or more positions (i.e. flow rates). In some embodiments, external control lines could be used, and a single coil instrumentation string with pressure/temperature sensors would be bundled inside each solvent injectors 205*a*-205*c*. Each flow regulator 217*a*-217*f* may comprise a steam valve, as available from the Halliburton Company of Houston, Tex.

Each solvent injector 205*a*-205*c* may comprise a lateral well (e.g. 7" in diameter) with a blank casing with slotted liner or wire wrapped sections aligned with the RF antenna assemblies 206*a*-206*c*. The plurality of solvent injectors 205*a*-205*c* is situated above the plurality of RF antenna assemblies 206*a*-206*c*, for example, about 3 m±1 m.

Each solvent injector 205*a*-205*c* illustratively includes a plurality of isolation packers 218, 219 (e.g. a thermal diverter pair, as available from the Halliburton Company of Houston, Tex.) with a respective flow regulator 217*a*-217*f* therebetween. Each of the plurality of isolation packers 218, 219 may enable feedthrough of control lines and measurement lines, hydraulic, electric, and optic fiber. The exemplary thermal diverter is suitable for high temperature applications which do not require perfect sealing, such as SAGD. For lower temperature applications, like this solvent injection method, other types of packers should also be considered, for example, swellable elastomeric packers, or cup type packers that use more common elastomers (e.g. Hydrogenated Nitrile Butadiene Rubber (HNBR)) than the high temperature thermoplastics used for thermal diverters.

Moreover, the plurality of solvent injectors 205*a*-205*c* includes a first solvent injector 205*a* aligned with a proximal end (i.e. a heel portion of the injector well) of the plurality of RF antenna assemblies 206*a*-206*c*, a second solvent injector 205*b* aligned with a medial portion (i.e. the first tubular conductor 213 of the plurality of producer wells 207*a*-207*c*) of the plurality of RF antenna assemblies 206*a*-206*c*, and a third solvent injector 205*c* aligned with a distal end (i.e. the second tubular conductor 215 of the injector well) of the plurality of RF antenna assemblies 206*a*-206*c*.

Each RF antenna assembly 206*a*-206*c* illustratively includes a dielectric heel isolator 212 coupled to the first tubular conductor 213. Also, each RF antenna assembly 206*a*-206*c* illustratively includes an RF transmission line 209 coupled to the RF source 204, first and second electrical contact sleeves 239*a*-239*b* respectively coupled between the first and second tubular conductors 213, 215 and the RF transmission line, a dielectric coupler 211 coupled between the first and second electrical contact sleeves, and a guide string 210 coupled to the second electrical contact sleeve. In some embodiments (FIG. 45), the RF antenna assemblies 206*a*-206*c* may be phased with each other to selectively or preferentially heat between the well pairs.

Figure 44:
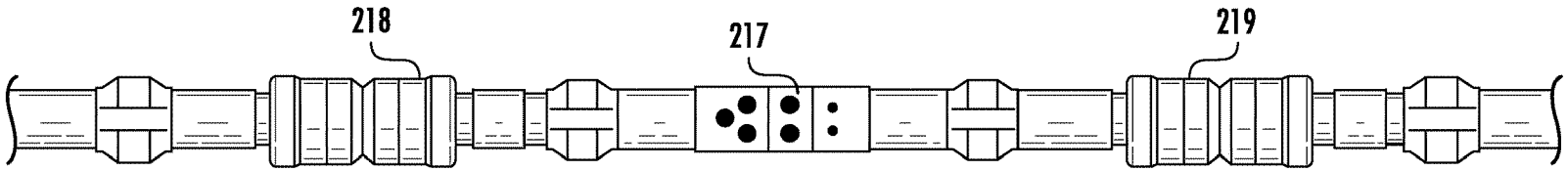
FIG. 44 is a schematic diagram of a portion of the solvent injector in the hydrocarbon resource recovery system of FIG. 41.
Figure 45:
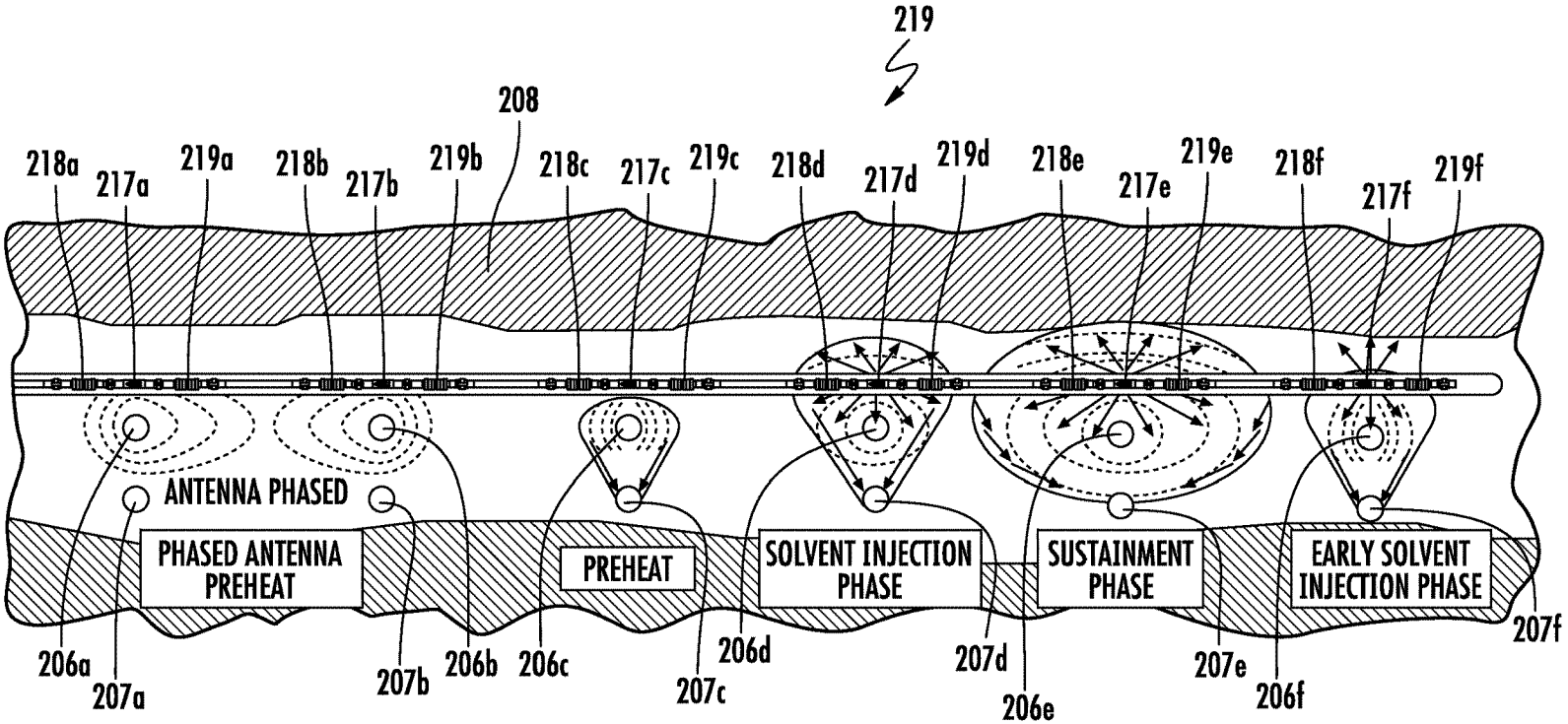
FIG. 45 is a schematic diagram of the solvent injector in the hydrocarbon resource recovery system of FIG. 41 during different phases of operation.

In FIG. 44, the plurality of isolation packers 218, 219 are double acting, in other words, they can oppose differential pressure from either direction. As such, half of each of the plurality of isolation packers 218, 219 is redundant, as shown in FIG. 45 (i.e. since pressure is coming only from one direction). In other embodiments, the distal portion of each isolation packer can be omitted.

Another aspect is directed to a method of hydrocarbon resource recovery with a hydrocarbon resource recovery system 203. The hydrocarbon resource recovery system 203 includes an RF source 204, and at least one RF antenna assembly 206*a*-206*c* coupled to the RF source and extending laterally within a first wellbore 236 in a subterranean formation 208 for hydrocarbon resource recovery. The at least one RF antenna assembly 206*a*-206*c* includes first and second tubular conductors 213, 215, and a dielectric isolator 214 coupled between the first and second tubular conductors to define a dipole antenna. The method comprises operating a plurality of solvent injectors 205*a*-205*c* within respective laterally extending wellbores extending transverse and above the at least one RF antenna assembly 206*a*-206*c*, the plurality of solvent injectors selectively injecting solvent into the subterranean formation 208 adjacent the at least one RF antenna assembly.

In operation, the RF source 204 is operated in two phases. During the start-up phase, the power level of the RF source 204 is slowly ramped up to a target power level of 2.0 kW/m of antenna length or greater. Once fluid communication is established with the producer well 207*a*-207*c*, the solvent injection can begin. The heating pattern around the plurality of RF antenna assemblies 206*a*-206*c* should follow a zip line path. Once antenna impedance is stabilized, the power level of the RF source 204 is reduced to 1-1.5 kW/m for the sustainment Also, helpfully, this embodiment of the hydrocarbon resource recovery system 203 provides an alternative approach to other systems where the solvent injecting apparatus and the RF antenna are integrated within the same wellbore. In the hydrocarbon resource recovery system 203, the separation of the solvent injection feature from the RF antenna assemblies 206*a*-206*c* may reduce complexity and enhance reliability. Moreover, the plurality of solvent injectors 205*a*-205*c* may provide improved selectivity as solvent application can be tightly controlled over several injector/producer well pairs.

Several benefits are derived from the hydrocarbon resource recovery system 203. First, the antenna liner is reduced in diameter, which reduces drilling and material costs. Additionally, since the injector well pumps are removed, costs and complexity are further reduced. Also, the complex solvent crossing at the dielectric heel isolator 212 is removed.

Figure 46A:
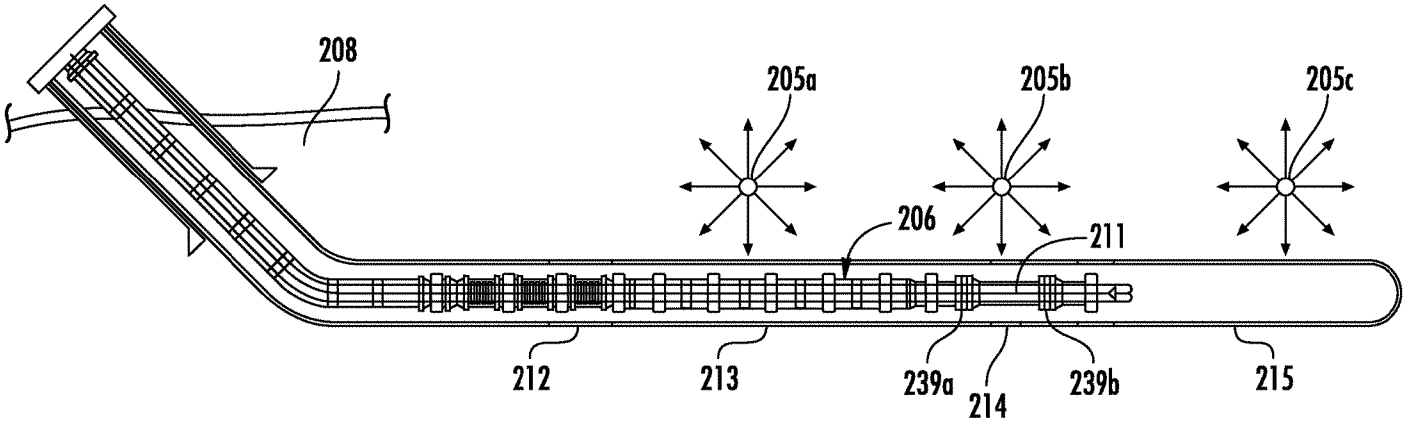
FIGS. 46A and 46B are schematic and cross-section views, respectively, of an embodiment of the RF antenna assembly from the hydrocarbon resource recovery system of FIG. 41.
Figure 46B:
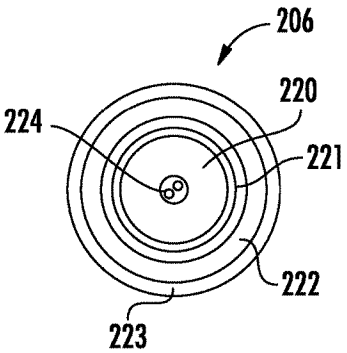

Referring now to FIGS. 46A-46B, each RF antenna assembly 206*a*-206*c* illustratively defines first and second fluid passageways 220, 221 configured to circulate a dielectric fluid from the surface (e.g. wellbore surface) of the subterranean formation 208. The first wellbore 236 illustratively includes a cased wellbore 223 defining the first and second fluid passageways 220, 221 between a respective RF antenna assembly 206*a*-206*c* and the cased wellbore. Here, the cased wellbore 223 refers to an antenna that has been cemented into place, i.e. fully cased in concert. The first fluid passageway 221 is the supply path from the surface of the subterranean formation 208, and the second fluid passageway 220 (surrounding the RF transmission line 224) is the return path back to the surface of the subterranean formation. Each RF antenna assembly 206*a*-206*c* defines an annular space 222 between the respective RF antenna assembly and the cased wellbore 223.

Advantageously, this embodiment may cause the antenna to be instantly in electromagnetic mode, i.e. no start-up phase or zip lining. Also, the thermal limits on dielectric isolator 214 are reduced and corrosion concerns are largely eliminated. The cased wellbore 223 would be circulated clean and filled with a high temperature mineral oil or dielectric type fluid. Positively, the antenna liner could be reduce to 9⅝" (from 10¾" with in typical approaches) in diameter, and electrical corner cases would be reduced using this configuration. Lastly, this embodiment provides for a known fluid within the dielectric isolator 212, and around the common mode current choke XXX.

This embodiment controls the fluid around the electromagnetic heating tool and puts a known fluid around the center node and choke assembly. Here, the antenna wellbore (case hole) was cemented, which allows the antenna of this embodiment to have a electrically isolating layer around it which could allow the antenna to instantly be in electromagnetic mode, i.e. no zip lining, or at least allow zip lining to occur at a much fast rate.

Figure 47A:
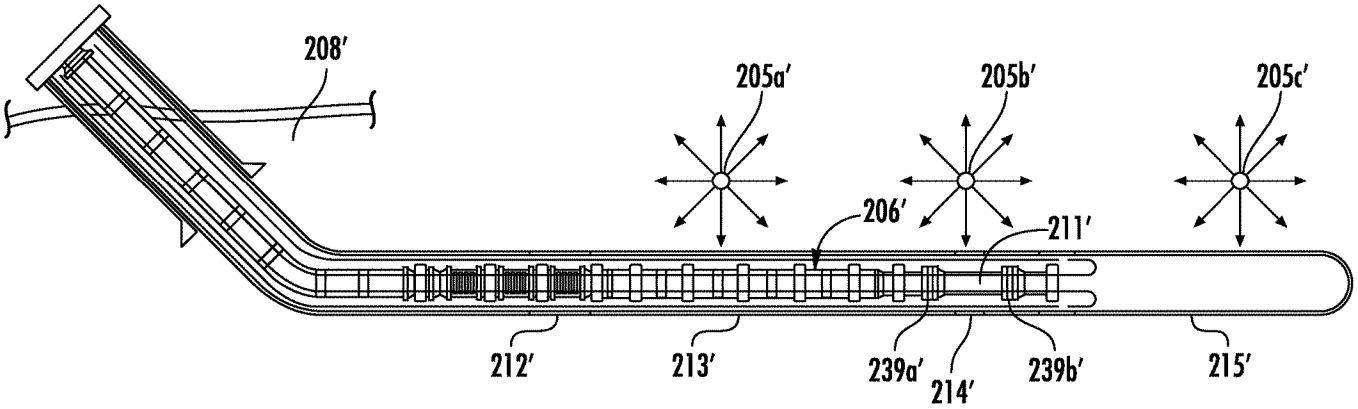
FIGS. 47A and 47B are schematic and cross-section views, respectively, of another embodiment of the RF antenna assembly from the hydrocarbon resource recovery system of FIG. 41.
Figure 47B:
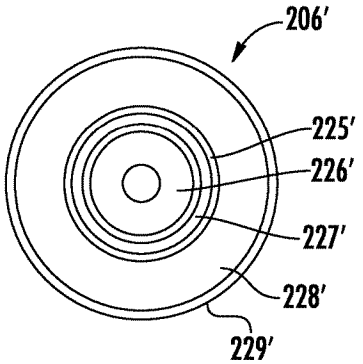

Referring now additionally to FIGS. 47A-47B, another embodiment of the RF antenna assembly 206' is now described. In this embodiment of the RF antenna assembly 206', those elements already discussed above with respect to FIGS. 42-47B are given prime notation and most require no further discussion herein. This embodiment differs from the previous embodiment in that this RF antenna assembly 206' has a different fluid passageway arrangement.

The first wellbore 236' illustratively includes a cased wellbore 229' defining first, second, and third fluid passageways 225', 227', 228' between a respective RF antenna assembly 206' and the cased wellbore, and an $N_2$ core 226' surrounding the first fluid passageway. Here, the cased wellbore 229' refers to an antenna that has been cemented into place, i.e. fully cased in concert. The first and second fluid passageways 225', 227' are the supply path from a surface of the subterranean formation 208', and the third fluid passageway 228' is the return path back to the surface of the subterranean formation.

This embodiment may cause the antenna to be instantly in electromagnetic mode, i.e. no start-up or zip lining. The RF transmission line is $N_2$ filled with oil flowing down inner and outer bodies and returning up casing annulus, which will provide for a power efficiency improvement. Also, the antenna liner could be reduced to 9⅝" in diameter, providing the benefits noted above.

Other features relating to hydrocarbon resource recovery systems are disclosed in co-pending applications: titled "HYDROCARBON RESOURCE RECOVERY SYSTEM AND COMPONENT WITH PRESSURE HOUSING AND RELATED METHODS," Ser. No. 15/893,872, filed Feb. 12, 2018; titled "HYDROCARBON RESOURCE RECOVERY SYSTEM AND RF ANTENNA ASSEMBLY WITH LATCHING INNER CONDUCTOR AND RELATED METHODS," Ser. No. 15/893,882, filed Feb. 12, 2018; titled "METHOD FOR OPERATING RF SOURCE AND RELATED HYDROCARBON RESOURCE RECOVERY SYSTEMS," Ser. No. 15/893,897, filed Feb. 12, 2018; titled "HYDROCARBON RESOURCE RECOVERY SYSTEM AND RF ANTENNA ASSEMBLY WITH THERMAL EXPANSION DEVICE AND RELATED METHODS," Ser. No. 15/893,921, filed Feb. 12, 2018, all incorporated herein by reference in their entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A hydrocarbon resource recovery system comprising:

a radio frequency (RF) source;

an RF antenna assembly coupled to said RF source and extending laterally within a first wellbore in a subterranean formation for hydrocarbon resource recovery, said RF antenna assembly comprising first and second tubular conductors, and a dielectric isolator coupled between said first and second tubular conductors to define a dipole antenna; and a plurality of solvent injectors within respective laterally extending second wellbores extending transverse and above said RF antenna assembly and configured to selectively inject solvent into the subterranean formation adjacent said RF antenna assembly.

2. The hydrocarbon resource recovery system of claim 1 comprising at least one other RF antenna assembly; and wherein each solvent injector comprises a plurality of flow regulators aligned with respective ones of said RF antenna assembly and said at least one other RF antenna assembly.

3. The hydrocarbon resource recovery system of claim 2 wherein said plurality of flow regulators each has a selective flow rate.

4. The hydrocarbon resource recovery system of claim 2 wherein each solvent injector comprises a plurality of isolation packers with a respective flow regulator therebetween.

5. The hydrocarbon resource recovery system of claim 1 wherein said plurality of solvent injectors comprises a first solvent injector aligned with a proximal end of said RF antenna assembly, a second solvent injector aligned with a medial portion of said RF antenna assembly, and a third solvent injector aligned with a distal end of said RF antenna assembly.

6. The hydrocarbon resource recovery system of claim 1 wherein said RF antenna assembly comprises a dielectric choke coupled to said first tubular conductor.

7. The hydrocarbon resource recovery system of claim 1 wherein said RF antenna assembly comprises an RF transmission line coupled between said RF source and said first and second tubular conductors.

8. The hydrocarbon resource recovery system of claim 1 wherein said RF antenna assembly defines first and second fluid passageways configured to circulate a dielectric fluid from a surface of the subterranean formation.

9. The hydrocarbon resource recovery system of claim 1 wherein the first wellbore comprises a cased first wellbore defining a fluid passageway between said RF antenna assembly and said cased first wellbore.

10. The hydrocarbon resource recovery system of claim 1 further comprising at least one producer well within the subterranean formation below said RF antenna assembly.

11. A hydrocarbon resource recovery system comprising:

a radio frequency (RF) source;

a plurality of RF antenna assemblies coupled to said RF source and extending laterally within respective laterally spaced first wellbores in a subterranean formation for hydrocarbon resource recovery, each RF antenna assembly comprising first and second tubular conductors, a dielectric isolator coupled between said first and second tubular conductors to define a dipole antenna, and a dielectric choke coupled to said first tubular conductor; and a plurality of solvent injectors within respective laterally extending second wellbores extending transverse and above said plurality of RF antenna assemblies and configured to selectively inject solvent into the subterranean formation adjacent said plurality of RF antenna assemblies, each solvent injector comprising a plurality of flow regulators aligned with respective ones of said plurality of RF antenna assemblies.

12. The hydrocarbon resource recovery system of claim 11 wherein said plurality of flow regulators each has a selective flow rate.

13. The hydrocarbon resource recovery system of claim 11 wherein each solvent injector comprises a plurality of isolation packers with a respective flow regulator therebetween.

14. The hydrocarbon resource recovery system of claim 11 wherein said plurality of solvent injectors comprises a first solvent injector aligned with a proximal end of a respective RF antenna assembly, a second solvent injector aligned with a medial portion of the respective RF antenna assembly, and a third solvent injector aligned with a distal end of the respective RF antenna assembly.

15. The hydrocarbon resource recovery system of claim 11 wherein each RF antenna assembly comprises an RF transmission line coupled between said RF source and said first and second tubular conductors.

16. The hydrocarbon resource recovery system of claim 11 wherein each RF antenna assembly defines first and second fluid passageways configured to circulate a dielectric fluid from a surface of the subterranean formation.

17. The hydrocarbon resource recovery system of claim 11 wherein each first wellbore comprises a cased first wellbore defining a fluid passageway between a respective RF antenna assembly and said cased first wellbore.

18. A method of hydrocarbon resource recovery with a hydrocarbon resource recovery system comprising a radio frequency (RF) source, and an RF antenna assembly coupled to the RF source and extending laterally within a first wellbore in a subterranean formation for hydrocarbon resource recovery, the RF antenna assembly comprising first and second tubular conductors, and a dielectric isolator coupled between the first and second tubular conductors to define a dipole antenna, the method comprising:

operating a plurality of solvent injectors within respective laterally extending second wellbores extending transverse and above the RF antenna assembly, the plurality of solvent injectors selectively injecting solvent into the subterranean formation adjacent the RF antenna assembly.

19. The method of claim 18 wherein the hydrocarbon resource recovery system comprises at least one other RF antenna assembly; and wherein each solvent injector comprises a plurality of flow regulators aligned with respective ones of the RF antenna assembly and the at least one other RF antenna assembly.

20. The method of claim 19 wherein the plurality of flow regulators each has a selective flow rate.

21. The method of claim 19 wherein each solvent injector comprises a plurality of isolation packers with a respective flow regulator therebetween.

22. The method of claim 18 wherein the plurality of solvent injectors comprises a first solvent injector aligned with a proximal end of the RF antenna assembly, a second solvent injector aligned with a medial portion of the RF antenna assembly, and a third solvent injector aligned with a distal end of the RF antenna assembly.

* * * * *